US009086664B2

(12) United States Patent
Matsunaka et al.

(10) Patent No.: US 9,086,664 B2
(45) Date of Patent: Jul. 21, 2015

(54) FIXING DEVICE WITH A HEAT GENERATING LAYER CONTAINING A HIGH MOLECULAR COMPOUND AND A CARBON FIBER, AND AN ELECTROPHOTOGRAPHIC IMAGE FORMING APPARATUS CONTAINING THE FIXING DEVICE

(71) Applicant: CANON KABUSHIKI KAISHA, Tokyo (JP)

(72) Inventors: Katsuhisa Matsunaka, Inagi (JP); Yutaka Arai, Kawasaki (JP); Jun Miura, Kawasaki (JP); Jiro Ishizuka, Moriya (JP); Shuichi Tamura, Moriya (JP); Ryo Yashiro, Tokyo (JP); Hiroto Sugimoto, Toride (JP); Naoki Akiyama, Toride (JP); Kenji Hashimoto, Nagareyama (JP); Yasuhiro Miyahara, Tokyo (JP); Hiroki Muramatsu, Tokyo (JP); Koji Sato, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/279,545

(22) Filed: May 16, 2014

(65) Prior Publication Data

US 2014/0248071 A1 Sep. 4, 2014

Related U.S. Application Data

(63) Continuation of application No. PCT/JP2013/007478, filed on Dec. 19, 2013.

(30) Foreign Application Priority Data

Dec. 26, 2012 (JP) ..... 2012-282982
Oct. 9, 2013 (JP) ..... 2013-211709
Oct. 9, 2013 (JP) ..... 2013-211711

(51) Int. Cl.
*G03G 15/20* (2006.01)

(52) U.S. Cl.
CPC ..... *G03G 15/2057* (2013.01); *G03G 15/2017* (2013.01)

(58) Field of Classification Search
CPC ..... G03G 15/2057
USPC ..... 399/328, 336, 333
See application file for complete search history.

(56) References Cited

U.S. PATENT DOCUMENTS 7,457,577 B2 11/2008 Matsunaka et al.
7,974,563 B2 7/2011 Sakai et al.

(Continued)

FOREIGN PATENT DOCUMENTS

JP 9-171889 A 6/1997
JP 2001-062380 A 3/2001

(Continued)

OTHER PUBLICATIONS

U.S. Appl. No. 14/280,891, filed May 19, 2014, Matsunaka et al.

(Continued)

*Primary Examiner* — Susan Lee
(74) *Attorney, Agent, or Firm* — Fitzpatrick, Cella, Harper & Scinto

(57) ABSTRACT

Provided is a fixing device, the heat generation amount of which can be obtained with a smaller amount of a microwave absorbing material. As a result, the start-up (warm-up) time for achieving a fixing temperature can be shortened without impairing characteristics such as flexibility, releasing property, and durability. The fixing device includes a heating member; a pressurizing member; and a microwave generating unit. It is configured to fix an unfixed toner on a recording material by passing the recording material through a nip formed between the heating member and the pressurizing member. The heating member includes a heat generating layer for generating heat with microwaves generated by the microwave generating unit. The heat generating layer contains a high molecular compound and a carbon fiber having an average fiber diameter of 80-150 nm, an average fiber length of 6-10 μm, and an absorption peak in a Raman spectrum resulting from a graphite structure.

8 Claims, 10 Drawing Sheets

(56) References Cited

U.S. PATENT DOCUMENTS

| | | | | |
|---|---|---|---|---|
| 8,005,413 | B2 | 8/2011 | Sakakibara et al. | |
| 8,224,223 | B2 | 7/2012 | Sakakibara et al. | |
| 8,369,763 | B2 | 2/2013 | Sakakibara et al. | |
| 8,401,450 | B2 | 3/2013 | Sekihara et al. | |
| 8,445,090 | B2 | 5/2013 | Nakajima et al. | |
| 8,626,046 | B2 | 1/2014 | Sekihara et al. | |
| 8,755,726 | B2 | 6/2014 | Sugimoto | |
| 2005/0214044 | A1* | 9/2005 | Sakakibara et al. | 399/333 |
| 2014/0105659 | A1 | 4/2014 | Miyahara | |
| 2014/0133892 | A1 | 5/2014 | Miura et al. | |

FOREIGN PATENT DOCUMENTS

| | | | |
|---|---|---|---|
| JP | 2002-213432 | A | 7/2002 |
| JP | 2006-137937 | A | 6/2006 |
| JP | 2006-259712 | A | 9/2006 |
| JP | 2008-225299 | A | 9/2008 |
| JP | 2009-109998 | A | 5/2009 |
| JP | 2010-160222 | A | 7/2010 |
| JP | 2011-085846 | A | 4/2011 |
| JP | 2011-186127 | A | 9/2011 |
| WO | 2006/041186 | A1 | 4/2006 |
| WO | 2014/097616 | A1 | 6/2014 |
| WO | 2014/103252 | A1 | 7/2014 |
| WO | 2014/112358 | A1 | 7/2014 |

OTHER PUBLICATIONS

U.S. Appl. No. 14/283,866, filed May 21, 2014, Matsunaka et al.

U.S. Appl. No. 14/310,345, filed Jun. 20, 2014, Miura et al.

* cited by examiner

FIXING DEVICE WITH A HEAT GENERATING LAYER CONTAINING A HIGH MOLECULAR COMPOUND AND A CARBON FIBER, AND AN ELECTROPHOTOGRAPHIC IMAGE FORMING APPARATUS CONTAINING THE FIXING DEVICE

CROSS-REFERENCE TO RELATED APPLICATIONS

This application is a continuation of International Application No. PCT/JP2013/007478, filed Dec. 19, 2013, which claims the benefit of Japanese Patent Application Nos. 2012-282982, filed Dec. 26, 2012, 2013-211709, filed Oct. 9, 2013, and 2013-211711, filed Oct. 9, 2013.

BACKGROUND OF THE INVENTION

1. Field of the Invention

The present invention relates to a fixing device to be used for an electrophotographic apparatus and an electrophotographic image forming apparatus.

2. Description of the Related Art

In general, in a heating and fixing device to be used in an electrophotographic system such as a laser printer or a copying machine, a pair of heated rotating members such as rollers, a film and a roller, a belt and a roller, or belts are brought into pressure contact with each other.

In addition, a recording material holding an image of an unfixed toner is introduced into a pressure-contact portion (fixing nip) formed by the rotating members and heated to melt the toner, with the result that the image is fixed to the recording material such as paper.

A rotating member with which an unfixed toner image held on the recording material is brought into contact is referred to as heating member and is called a fixing roller, a fixing film, or a fixing belt depending on its form.

As a method of heating a heating member, there are given a method involving heating a heating member by transmitting heat generated by a heat generator to the heating member through contact therewith or without contact therewith, and a method involving causing a heating member to generate heat itself.

As the method involving transmitting heat generated by a heat generator to a heating member, there is generally used a method involving heating a heating member with radiation heat by disposing a halogen heater inside the heating member. There is also used a method involving heating a heating member only in a fixing nip portion by bringing a ceramic heater into abutment with an inner surface of the heating member and sliding the ceramic heater.

As the method involving causing a heating member to generate heat itself, there has been used a method involving disposing a conductor layer made of a metal or the like as a base layer for a heating member and generating an eddy current by induction heating, thereby causing the conductor layer to generate heat itself (see Japanese Patent Application Laid-Open No. H09-171889).

Further, there has been known a method involving providing a microwave generating unit in a fixing device and generating a microwave, thereby causing a heating member to perform self-heating (see Japanese Patent Application Laid-Open No. 2010-160222).

In general, a fixing device is required to fix a toner with smaller electric power, and hence an attempt has been made to reduce portions serving as heat resistance to enhance heat efficiency. Therefore, it is important that heating of unnecessary portions be minimized and only necessary portions be supplied with heat by heating portions closer to a recording material from the viewpoint of energy saving. Thus, a system of causing a heating member to generate heat itself is advantageous in this respect.

Further, in recent years, there has been a demand for further shortening start-up time, and a fixing device is required to rapidly raise the temperature of the surface of a heating member up to toner fixable temperature, that is, to shorten warm-up time.

SUMMARY OF THE INVENTION

In a heat generating system using a microwave, it is necessary to form a layer which performs self-heating by absorbing a microwave in a heating member. It is known that the self-heating layer enables the heating member to have a function of self-heating when a material which absorbs a microwave to generate heat is added to a base layer, an elastic layer, or a surface layer. Further, as the material which absorbs a microwave to generate heat, carbon black, silicon carbide, and the like have heretofore been used. However, in order to raise the temperature of a heating member so that a toner can be fixed in a short period of time, it is necessary to add a large amount of a microwave absorbing material to the heating member. As a result, the following problem is caused: the characteristics such as flexibility, releasing property, and durability, which are functions originally required of the layers of the heating member, are impaired.

Further, when a trace amount of a microwave absorbing material is added to such a degree that the functions of the layers of the heating member are not impaired, a heat generation amount becomes small, and hence a long period of time is required so as to raise the temperature within a practical electric power range. As a result, the start-up time (warm-up time) of a fixing device is prolonged, which is a problem for practical use.

In view of the foregoing, the present invention is directed to providing a fixing device including a heating member of a heating system using a microwave, which is capable of providing high-quality electrophotographic images.

According to one aspect of the present invention, there is provided a fixing device, comprising: a heating member; a pressurizing member; and a microwave generating unit, the fixing device being configured to fix an unfixed toner on a recording material by passing the recording material through a nip formed by the heating member and the pressurizing member, wherein: the heating member comprises a heat generating layer for generating heat with a microwave generated by the microwave generating unit; the heat generating layer contains a high molecular compound and a carbon fiber; and the carbon fiber has an average fiber diameter of 80 nm or more and 150 nm or less, has an average fiber length of 6 μm or more and 10 μm or less, and has, in a Raman spectrum, an absorption peak resulting from a graphite structure.

According to another aspect of the present invention, there is provided an electrophotographic image forming apparatus, comprising: an electrophotographic photosensitive drum; a charging device for charging the electrophotographic photosensitive drum; and a fixing device for heating a toner image transferred onto a recording material to fix the toner image on the recording material, wherein the fixing device comprises the above-described fixing device.

According to the present invention, there is provided the fixing device whose required heat generation amount can be obtained with a smaller amount of a microwave absorbing material, and hence the start-up time (so-called warm-up time) for achieving fixable temperature of the fixing device can be shortened without impairing the characteristics such as flexibility, releasing property, and durability, which are functions required of the layers of a heating member.

Further features of the present invention will become apparent from the following description of exemplary embodiments with reference to the attached drawings.

DESCRIPTION OF THE EMBODIMENTS

Figure 1:
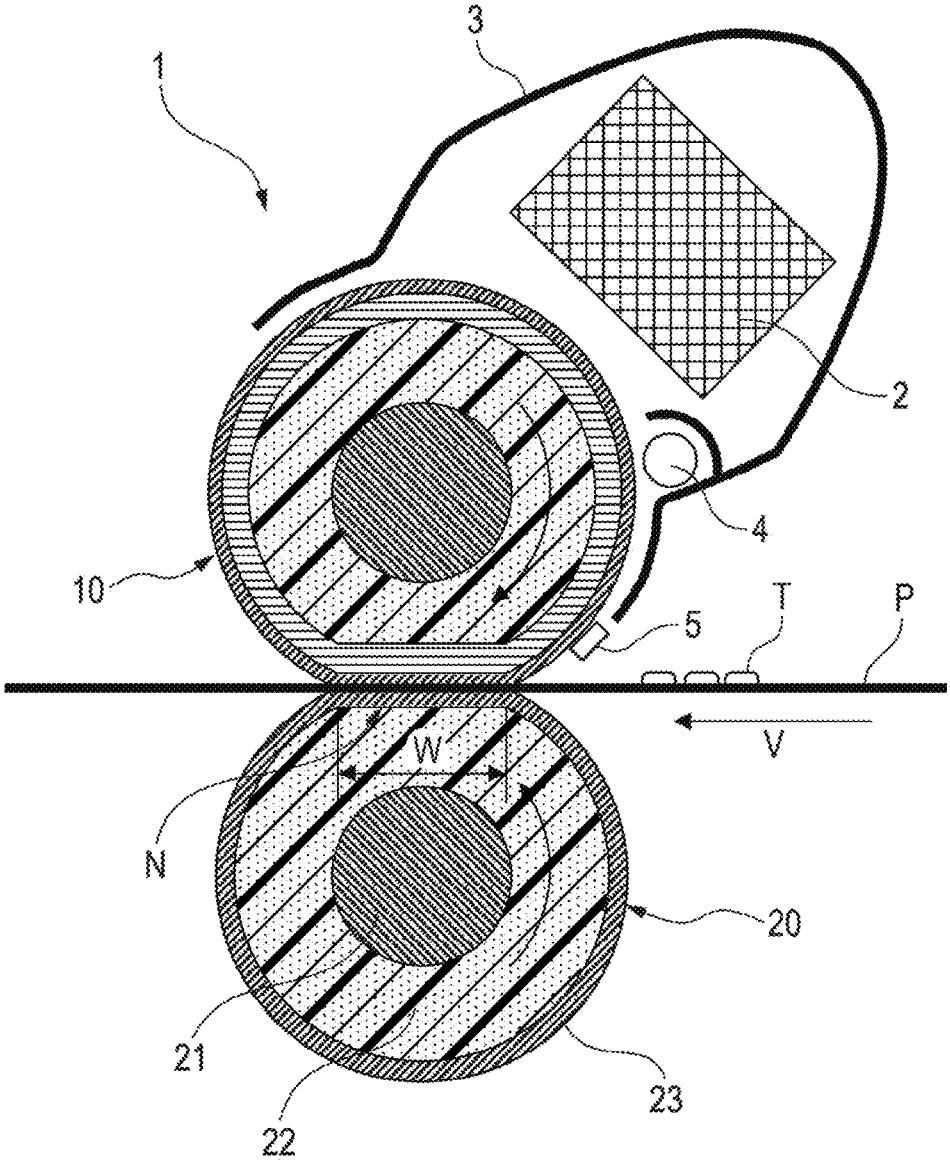
FIG. 1 is a schematic sectional view illustrating an example of a fixing device according to the present invention.

Preferred embodiments of the present invention will now be described in detail in accordance with the accompanying drawings.

The inventors of the present invention have earnestly studied a configuration capable of allowing a heating member of a heating system using a microwave to generate heat more efficiently. As a result, the inventors of the present invention have found that a heating member including a heat generating layer containing particular carbon fiber as a microwave absorbing material has excellent heat generating performance using a microwave. The present invention is based on such novel finding.

A fixing device according to the present invention includes a heating member, a pressurizing member, and a microwave generating unit, the fixing device being configured to fix an unfixed toner on a recording material by passing the recording material through a nip formed between the heating member and the pressurizing member. The heating member includes a heat generating layer for generating heat with a microwave generated by the microwave generating unit, and the heat generating layer contains a high molecular compound and a carbon fiber. The carbon fiber has an average fiber diameter of 80 nm or more and 150 nm or less, has an average fiber length of 6 μm or more and 10 μm or less, and has, in a Raman spectrum, an absorption peak resulting from a graphite structure.

It has been clarified by the studies of the inventors of the present invention that, by virtue of the above-mentioned features, the heating member absorbs a microwave efficiently and achieves a large heat generation amount. The inventors of the present invention presume the reason for such large heat generation amount as follows.

Specifically, carbon itself has an appropriate resistance value, and hence, when the carbon is irradiated with a microwave, the carbon, in particular, in the vicinity of the surface of the carbon absorbs the microwave to generate a current therein, with the result that resistive heating is caused. In this case, owing to a structure of a fiber form such as the shape as described above, a space through which a current flows is sufficiently ensured in the fiber. Further, the carbon fiber comes into contact with each other even in a small added amount, and hence a large current can flow through contact points of the carbon fiber. Therefore, it is considered that efficient heat generation is achieved even in a small added amount of the carbon fiber.

On the other hand, it is presumed that carbon exhibits different behavior in the case where the carbon has a particle shape. When carbon particles each having a relatively large particle diameter such as graphite particles are used, a specific surface area becomes small relatively. Therefore, the absorption of microwaves on the surfaces of the particles is reduced, with the result that heat generation is less likely to occur. On the other hand, when particles each having a relatively small particle diameter such as carbon black particles are used, a specific surface area can be ensured, but the volume of each particle is too small. Accordingly, a space through which a current flows cannot be ensured in the particle. Further, the contact between the particles is less likely to occur relatively. Therefore, the current does not flow easily, and consequently, sufficient heat generation is considered to be less likely to occur.

That is, in order to realize efficient heat generation using a microwave even in the case of a small added amount, it is preferred that carbon have a particle form in which each particle has a sufficient volume while keeping a large specific surface area and each particle can come into contact with other particles reliably. As a result, it is considered that the carbon fiber having an average fiber diameter and average fiber length in the above-mentioned ranges and having an absorption peak resulting from a graphite structure in a Raman spectrum, specifically, for example, vapor grown carbon fiber contributes to the enhancement of heat generation efficiency.

The fixing device according to the present invention is described below based on specific configurations.

(1) Fixing Device

An electrophotographic heating and fixing device is appropriately selected considering the conditions that a pair of heated rotating members such as rollers, a film and a roller, a belt and a roller, or belts are brought into pressure contact with each other, and the conditions such as a process speed and a size as an entire electrophotographic image forming apparatus.

Japanese Patent Application Laid-Open No. H09-171889 exemplifies configurations of various fixing devices. A fixing device using a roller-shaped heating member is hereinafter described as a specific example. Note that a configuration of the fixing device described below is an example of the present invention. The scope of the present invention has only to be satisfied in order to obtain the effects of the present invention, and the present invention is by no means limited by this configuration.

FIG. 1 is a schematic sectional view of the fixing device according to the present invention.

A fixing device 1 includes a fixing roller 10 (configuration corresponding to a "heating member" of claim 1) serving as a rotatable heating member for heating an image on a recording material in a fixing nip portion N and a rotatable pressurizing roller 20 (configuration corresponding to a "pressurizing member" of claim 1) serving as a pressurizing member.

The fixing roller 10 and the pressurizing roller 20 are arranged substantially in parallel to each other vertically and brought into pressure contact with each other with a pressure spring (not shown) at an end portion. Thus, the fixing nip portion (pressure-contact nip portion) N with a predetermined width is formed in a recording material conveyance direction between the fixing roller 10 and the pressurizing roller 20.

The fixing roller 10 is rotated by drive device (not shown) at a predetermined circumferential speed in a clockwise direction indicated by an arrow. The pressurizing roller 20 is driven to rotate by the rotation of the fixing roller 10. Note that the fixing roller 10 and the pressurizing roller 20 may be rotated separately.

A microwave generating unit 2 (configuration corresponding to a "microwave generating unit" of claim 1) generates a microwave to the fixing roller 10 and heats the fixing roller 10 from outside. The microwave generating unit 2 generates a microwave of 300 to 1,500 W having a frequency of 300 MHz to 30 GHz from a microwave generating source such as a magnetron provided in the microwave generating unit 2. Note that a usable frequency range of a microwave to be output is not limited, but a frequency of 2,450 MHz is widely used in a microwave heating device because a practical range is defined as an industrial, scientific and medical band (so-called ISM band) by the International Telecommunication Union.

The microwave generating unit 2 and the fixing roller 10 are arranged at a distance of 1 mm or more in a non-contact state so as to prevent the foreign matters and toner adhering onto the fixing roller from being transferred.

A microwave reflecting member 3 made of a metal such as aluminum is provided on the periphery of the microwave generating unit 2 and the fixing roller 10 forming the fixing device 1. This configuration can prevent a microwave generated by the microwave generating unit 2 from leaking to outside of the fixing device, and can reflect and transmit the microwave to the surface of the fixing roller 10. The microwave reflecting member 3 may have a mesh structure as long as it can reflect a microwave.

A reflecting member for diffusing a microwave (not shown) is provided in the microwave generating unit 2 so that the entire region of the fixing roller 10 in a length direction (direction perpendicular to the drawing surface) can be irradiated with a microwave uniformly.

The length dimension (direction perpendicular to the drawing surface) of the roller portion of each of the fixing roller 10 and the pressurizing roller 20 is larger than the maximum paper passage width of the fixing device.

The fixing roller 10 which is rotating is heated by the microwave generating unit 2 and is supplied with a heat quantity necessary and sufficient for fixing an unfixed toner image T on a recording material P in the fixing nip portion N.

After the unfixed toner image T is formed on the recording material P in an image forming section (not shown), the recording material P is sent to the fixing device 1, and introduced into the fixing nip portion N formed by the fixing roller 10 and the pressurizing roller 20 to be held and conveyed. While the recording material P is being held and conveyed in the fixing nip portion N, the recording material P is heated by the fixing roller 10 for a time "t" per rotation of the roller, and is supplied with a pressure of the nip portion, with the result that the unfixed toner image T is fixed under thermal pressure on the recording material P as a permanent fixed image.

Figure 2A:
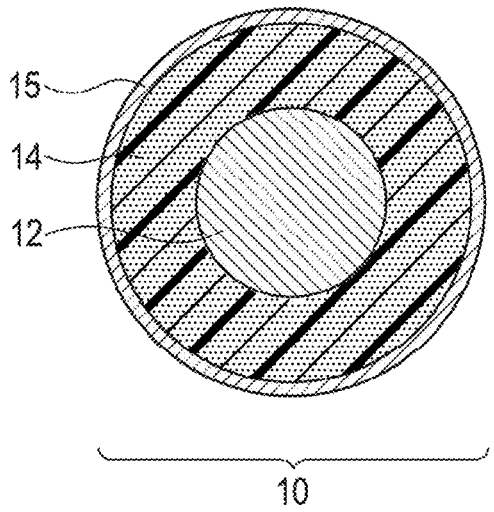
FIG. 2A is a schematic transverse sectional view of a heating member according to the present invention.
Figure 2B:
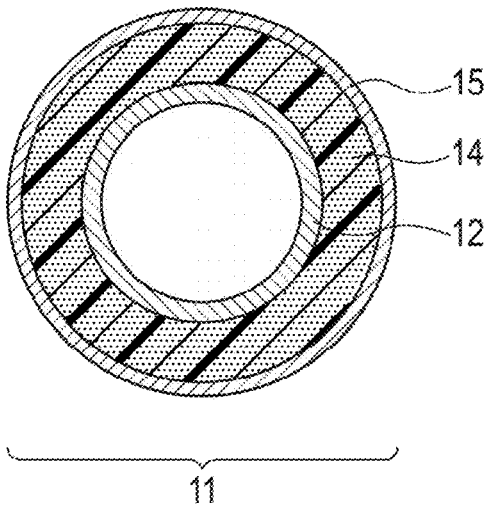
FIG. 2B is a schematic transverse sectional view of a heating member according to the present invention.
Figure 2C:
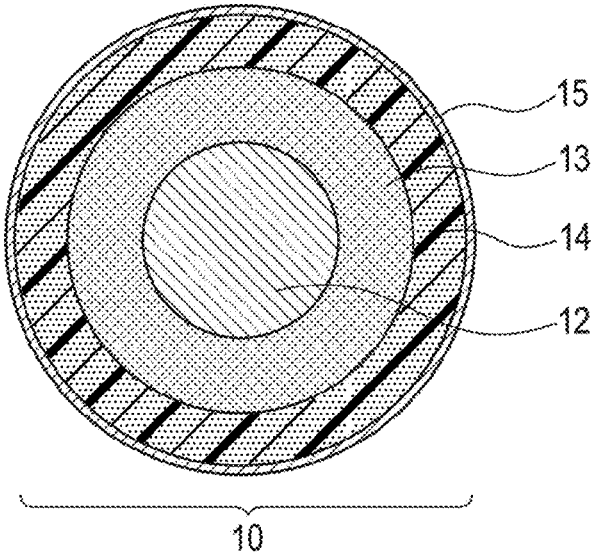
FIG. 2C is a schematic transverse sectional view of a heating member according to the present invention.

(2) Outline of configuration of heating member FIGS. 2A to 2C are schematic sectional views illustrating one embodiment of an electrophotographic heating member to be used in the fixing device according to the present invention. In FIG. 2A, a roller-shaped heating member (fixing roller) 10 is illustrated. Further, in FIG. 2B, a belt-shaped heating member (fixing belt) 11 is illustrated. In general, the heating member is called a fixing belt in the case where a substrate itself is greatly deformed to form a fixing nip, and the heating member is called a fixing roller in the case where a substrate itself is hardly deformed and a fixing nip portion is formed by the elastic deformation of an elastic layer.

In FIGS. 2A and 2B, a substrate 12, an elastic layer 14, and a releasing layer 15 are illustrated. The releasing layer 15 is in some cases fixed to the circumferential surface of the elastic layer 14 through intermediation of an adhesive layer (not shown).

Further, FIG. 2C illustrates a roller-shaped heating member (fixing roller) 10 according to another embodiment of the present invention, and in FIG. 2C, a heat insulation layer 13 is illustrated.

As a specific configuration of the heating member according to the present invention, there is given a heating member including a substrate, an elastic layer, and a releasing layer in the stated order, in which at least one of the elastic layer and the releasing layer is a heat generating layer for generating heat with a microwave, the heat generating layer containing a high molecular compound and a carbon fiber having an average fiber diameter of 80 nm or more and 150 nm or less, an average fiber length of 6 μm or more and 10 μm or less, and having, in a Raman spectrum, an absorption peak resulting from a graphite structure (hereinafter sometimes referred to simply as "carbon fiber").

Figure 3:
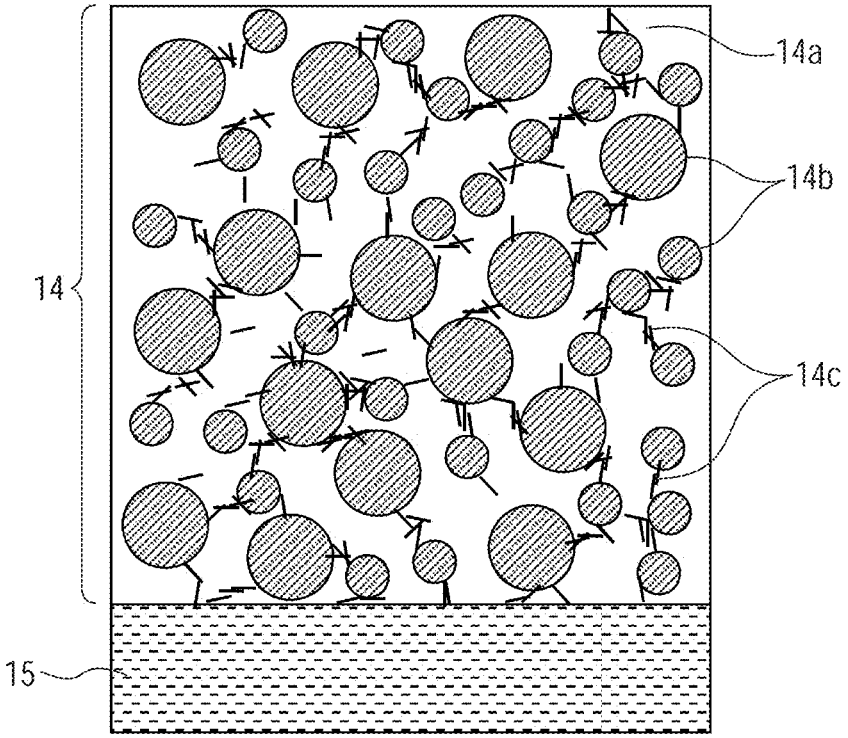
FIG. 3 is a sectional view of a vicinity of a surface of a heating member including an elastic layer as a heat generating layer according to the present invention.

FIG. 3 is a view schematically illustrating a cross-section of an enlarged layer configuration in the vicinity of a surface of the heating member in which the elastic layer contains a microwave absorbing material so as to serve as a heat generating layer as an example. In FIG. 3, the elastic layer 14 serving as a heat generating layer, a silicone rubber 14*a* serving as a base material, a filler 14*b*, and a carbon fiber 14*c* serving as a microwave absorbing material are illustrated. Those elements are described later in detail.

Each layer of the heating member is hereinafter described, and a use method therefor is described.

(2-1) Substrate

As the substrate 12, for example, there is used: a metal or an alloy such as aluminum, iron, stainless steel, or nickel; an inorganic material such as a ceramic or glass; or a heat-resistant high molecular compound such as polyimide or polyamide imide.

In the case where the heating member has a roller shape as in the fixing roller 10, a cored bar is used for the substrate 12. As a material for the cored bar, for example, there are given: metals and alloys such as aluminum, iron, and stainless steel;

and inorganic materials such as a ceramic and glass. In order to concentrate a microwave on the heat generating layer of the fixing roller, a metal which does not absorb a microwave and has a high reflectance is desired. In this case, even when the inside of the cored bar is hollow, it is appropriate that the cored bar have strength withstanding an applied pressure in the fixing device. Further, in the case where the cored bar is hollow, an auxiliary heat source may be provided therein.

In the case where the heating member has a belt shape as in the fixing belt 11, as the substrate 12, for example, there are given a metal or an alloy such as an electroformed nickel sleeve or a stainless sleeve, or a heat-resistant resin belt made of a high molecular compound such as polyimide or polyamide imide. When a high molecular compound is used for the substrate 12, the substrate itself is also allowed to serve as a heat generating layer capable of generating heat with a microwave by dispersing a carbon fiber in the high molecular compound, followed by forming.

A layer (not shown) for imparting a function such as wear resistance or heat insulation property is further provided on an inner surface of the fixing belt in some cases. A layer (not shown) for imparting a function such as adhesiveness with the elastic layer is further provided on an outer surface of the fixing belt in some cases.

(2-2) Elastic Layer, Heat Insulation Layer, and Production Methods Therefor

The elastic layer 14 is expected to serve as a layer for imparting elasticity to the heating member, the elasticity allowing the heating member to follow unevenness of paper fibers without squashing a toner during fixing. Further, when the elastic layer 14 itself has high heat insulation property, the elastic layer 14 serves to prevent heat generated in the elastic layer serving as a heat generating layer from permeating the substrate 12.

In order to express such function, a heat-resistant high molecular compound is used for the elastic layer 14. In particular, a heat-resistant rubber such as a silicone rubber or a fluorine rubber is preferably used as the base material. Of those, an addition-curing type silicone rubber is preferably cured to form the elastic layer 14.

(2-2-1) Addition-Curing Type Silicone Rubber

In FIG. 3, the silicone rubber 14*a* is constituted of the addition-curing type silicone rubber.

The addition-curing type silicone rubber generally includes an organopolysiloxane having an unsaturated aliphatic group, an organopolysiloxane having active hydrogen bonded to silicon, and a platinum compound as a crosslinking catalyst.

Examples of the organopolysiloxane having an unsaturated aliphatic group include:

a linear organopolysiloxane in which each of both terminals of its molecule is represented by $(R^1)_2R^2SiO_{1/2}$ and intermediate units thereof are represented by $(R^1)_2SiO$ and $R^1R^2SiO$; and a branched organopolysiloxane in which its intermediate unit includes $R^1SiO_{3/2}$ or $SiO_{4/2}$.

In this case, $R^1$ represents a monovalent unsubstituted or substituted hydrocarbon group containing no aliphatic unsaturated group and bonded to a silicon atom. Specific examples thereof include: an alkyl group (e.g., a methyl group, an ethyl group, a propyl group, a butyl group, a pentyl group, or a hexyl group); an aryl group (e.g., a phenyl group); and a substituted hydrocarbon group (e.g., a chloromethyl group, a 3-chloropropyl group, a 3,3,3-trifluoropropyl group, a 3-cyanopropyl group, or a 3-methoxypropyl group).

In particular, from the viewpoints that synthesis and handling are easy and excellent heat resistance can be obtained, it is preferred that 50% or more of $R^1$ represent methyl groups, and it is particularly preferred that all $R^1$ represent methyl groups.

In addition, $R^2$ represents an unsaturated aliphatic group bonded to a silicon atom. Examples thereof include a vinyl group, an allyl group, a 3-butenyl group, a 4-pentenyl group, and a 5-hexenyl group. From the viewpoints that synthesis and handling are easy and a crosslinking reaction can be easily performed, a vinyl group is preferred.

In addition, the organopolysiloxane having active hydrogen bonded to silicon is a crosslinking agent for forming a crosslinked structure by a reaction with an alkenyl group of an organopolysiloxane component having an unsaturated aliphatic group through a catalytic action of the platinum compound.

The number of hydrogen atoms bonded to a silicon atom in the organopolysiloxane having active hydrogen bonded to silicon is a number greater than 3 per molecule on average.

An organic group bonded to a silicon atom in the organopolysiloxane having active hydrogen bonded to silicon is exemplified by an unsubstituted or substituted monovalent hydrocarbon group in the same range as that of $R^1$ of the organopolysiloxane component having an unsaturated aliphatic group. In particular, a methyl group is preferred from the viewpoint that synthesis and handling are easy.

The molecular weight of the organopolysiloxane having active hydrogen bonded to silicon is not particularly limited.

In addition, the viscosity of the organopolysiloxane at 25° C. falls within the range of preferably 10 $mm^2/s$ or more and 100,000 $mm^2/s$ or less, more preferably 15 $mm^2/s$ or more and 1,000 $mm^2/s$ or less because when the viscosity of the organopolysiloxane at 25° C. falls within the range, there is no possibility that the organopolysiloxane is volatilized during storage to prevent the achievement of a desired degree of crosslinking or physical properties of a formed product, synthesis and handling are easy, and the organopolysiloxane can easily and uniformly be dispersed in the system.

Any one of linear, branched, and cyclic siloxane skeletons may be used as the siloxane skeleton, and a mixture thereof may be used. In particular, a linear siloxane skeleton is preferred from the viewpoint of ease in synthesis. Si—H bonds may be present in any siloxane units in the molecule. It is preferred that at least part thereof be present in a siloxane unit at a molecular terminal such as a $(R^1)_2HSiO_{1/2}$ unit.

The addition-curing type silicone rubber contains an unsaturated aliphatic group in an amount of preferably 0.1% by mole or more and 2.0% by mole or less, particularly preferably 0.2% by mole or more and 1.0% by mole or less with respect to 1 mol of silicon atoms.

(2-2-2) Carbon Fiber

The elastic layer 14 contains a carbon fiber for imparting heat generating performance of the heating member.

In FIG. 3, the carbon fiber 14*c* described below are illustrated. As the carbon fiber, PAN-based carbon fiber, pitch-based carbon fiber, vapor grown carbon fiber, and the like are generally known. From the viewpoint of heat generation efficiency, it is preferred to use vapor grown carbon fiber. The vapor grown carbon fiber is obtained by subjecting hydrocarbon and hydrogen as raw materials to pyrolysis in a vapor phase in a heating furnace to grow in a fibrous form with catalyst fine particles being a core. The carbon fiber is known in which the fiber diameter and fiber length are controlled by the kind/size/composition of the raw materials and catalyst; reaction temperature/atmospheric pressure; reaction time; and the like, and a graphite structure has been further developed by heat treatment after the reaction. The fiber has a multi-layered structure in a radial direction, exhibiting a shape in which graphite structures are laminated in a tubular shape.

The presence of a graphite structure can be confirmed because the graphite structure exhibits a very sharp absorption peak in the vicinity of 1,570 to 1,580 $cm^{-1}$ when a Raman spectrum is measured. The graphite structure exhibits electrical conductivity owing to the presence of free electrons therein and is capable of generating heat owing to a current which flows when the graphite structure absorbs a microwave. It is preferred that the carbon fiber having an average fiber diameter of about 80 to 150 nm and an average fiber length of about 6 to 10 μm.

Herein, the average fiber diameter and average fiber length of each of the carbon fiber contained in the elastic layer are determined by the following methods.

That is, a predetermined amount (for example, about 10 g) of a sample is cut out from the elastic layer through use of a razor or the like. The sample is placed in a crucible made of porcelain and heated at 600° C. for about 1 hour in a nitrogen atmosphere to incinerate and remove organic components such as a resin and a rubber in the elastic layer. The carbon fiber remains as a residue component in the crucible without being decomposed by firing in the nitrogen atmosphere.

1,000 carbon fibers in the residue component are selected at random. The carbon fiber is observed with a scanning electron microscope (trade name: JSM-5910V, manufactured by JEOL Ltd.) at a magnification of 30,000 times, and the fiber lengths thereof and the fiber diameters at fiber end portions thereof are measured through use of digital image analysis software (trade name: Quick Grain Standard, manufactured by Innotech Corporation). Then, arithmetic average values of the fiber lengths and fiber diameters of the respective carbon fibers are defined as an average fiber length and an average fiber diameter.

The vapor grown carbon fiber has a very high heat conductivity of about 1,200 W/(m·K) in a fiber length direction and an electrical conductivity of about $1.0\times10^{-4}$ Ω·cm, and hence can form a heat flow path and a conduction path in the elastic layer. By virtue of those effects, the heat conductivity and electrical conductivity of the entire elastic layer can be enhanced remarkably.

The content of the carbon fiber to be contained in the elastic layer is preferably 0.1% by volume or more, more preferably 0.5% by volume or more with respect to the elastic layer from the viewpoint of heat generation property. On the other hand, when the carbon fiber is contained in a large amount in the elastic layer, although the heat generation performance is enhanced, it becomes difficult to generate heat uniformly owing to the degraded dispersibility of the carbon fiber. Therefore, the content of the carbon fiber is preferably 20% by volume or less, more preferably 10% by volume or less with respect to the elastic layer. A uniform and sufficient heat generation amount can be obtained by setting the content of the carbon fiber within the above-mentioned range.

(2-2-3) Inorganic Filler

The elastic layer 14 may further contain an inorganic filler as a filler other than the carbon fiber. In general, in order to enhance heat transfer performance of the heating member and impart functions such as reinforcing property, heat resistance, processability, and electrical conductivity, various materials can be selected. For the purpose of enhancing heat transfer performance, specifically, there may be given an inorganic material, in particular, a metal, a metal compound, or the like.

Specific examples of the inorganic filler to be used for the purpose of enhancing heat transfer property include: silicon carbide; silicon nitride; boron nitride; aluminum nitride; alumina; zinc oxide; magnesium oxide; silica; copper; aluminum; silver; iron; nickel; and metal silicon.

In FIG. 3, the filler **14*b*** corresponds to the inorganic filler.

One kind of those inorganic fillers may be used alone, or two or more kinds thereof may be used as a mixture. From the viewpoints of ease of handling and dispersibility, the average particle diameter of the inorganic filler is preferably 1 μm or more and 50 μm or less.

Herein, the average particle diameter of the inorganic filler in the elastic layer is determined with a flow particle image analyzer (trade name: FPIA-3000; manufactured by Sysmex Corporation).

Specifically, a sample cut out from the elastic layer is placed in a crucible made of porcelain. The sample is heated to 1,000° C. in a nitrogen atmosphere to decompose and remove a rubber component. In this stage, an inorganic filler and vapor grown carbon fiber contained in the sample are present in the crucible. Then, the crucible is heated to 1,000° C. in an air atmosphere to burn the vapor grown carbon fibers. Consequently, only the inorganic filler contained in the sample remains in the crucible. The inorganic filler in the crucible is cracked so as to be primary particles through use of a mortar and a pestle, and thereafter the primary particles are dispersed in water to prepare a sample solution. The sample solution is supplied to the particle image analyzer. In the analyzer, the sample solution is introduced into and passed through an imaging cell, and the inorganic filler is photographed as a still image.

A diameter of a circle (hereinafter sometimes referred to as "equal area circle") having an area equal to that of a particle image (hereinafter sometimes referred to as "particle projected image") of the inorganic filler projected onto a plane is defined as a diameter of the inorganic filler regarding the particle image. Then, equal area circles of 1,000 pieces of the inorganic filler are obtained, and an arithmetic average value thereof is defined as an average particle diameter of the inorganic filler.

The heat insulation layer 13 is an optional layer which may be provided as a layer between the substrate 12 and the elastic layer 14 in the case where the heating member has a roller shape. The heat insulation layer has an effect of preventing heat generated in the elastic layer serving as a heat generating layer from being transmitted to the substrate and allowing the heat generated in the elastic layer to be more effectively used for heating a recording material and an unfixed toner. A heat-resistant high molecular compound is used for the heat insulation layer, and in particular, it is preferred that a heat-resistant rubber such as a silicone rubber or a fluorine rubber be used as a base material. It is particularly preferred that the heat insulation layer be formed by curing an addition-curing type silicone rubber.

Further, when the heat insulation layer 13 is formed by blending hollow microballoons formed of glass or a resin, as a filler, in the base material such as the silicone rubber described above for the purpose of reducing heat conductivity, an elastic layer having lower heat conductivity can be formed as compared to the case where only the base material is used. Further, a similar effect can also be expected by using a silicone rubber layer containing a water-absorbing polymer or a sponge rubber layer obtained by subjecting a silicone rubber to hydrogen blowing. The purpose of the heat insulation layer can be achieved even by using a solid rubber layer as long as the solid rubber layer has low heat conductivity.

(2-2-4) Production Method for Elastic Layer

As the production method for the elastic layer, processing methods such as a metallic molding method, a blade coating method, a nozzle coating method, and a ring coating method are widely known as disclosed in, for example, Japanese Patent Application Laid-Open Nos. 2001-062380 and 2002-213432. The elastic layer can be formed by heating and crosslinking a mixture on a substrate or a heat insulation layer by any of those methods.

Figure 4:
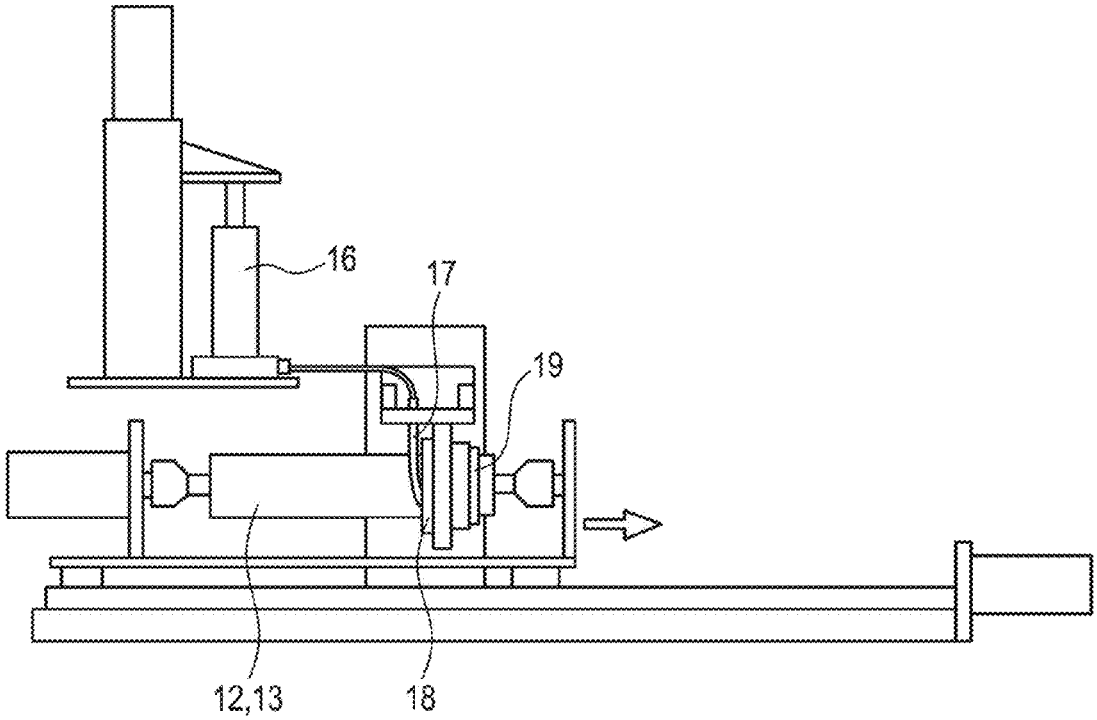
FIG. 4 is a schematic explanatory diagram of an apparatus to be used for producing the elastic layer of the heating member.

FIG. 4 is a schematic view illustrating a method using a so-called ring coating method as an example of a process of forming the elastic layer 14 on the substrate 12 or the heat insulation layer 13.

A raw material mixture for an elastic layer obtained by weighing a filler and an uncrosslinked base material (addition-curing type silicone rubber in this example), blending the filler in the uncrosslinked base material and thoroughly mixing and defoaming the mixture through use of, for example, a planetary universal mixer is supplied to a cylinder pump 16 and pressure-fed, whereby the mixture is applied to the circumferential surface of the substrate 12 or the heat insulation layer 13 from a coating head 18 through a coating solution supply nozzle 17. A coat (uncrosslinked elastic layer coat) 19 of the raw material mixture can be formed on the circumferential surface of the substrate 12 or the heat insulation layer 13 by moving the substrate 12 in a right direction of the drawing surface at a predetermined speed concurrently with the application of the mixture.

The thickness of the coat can be controlled by the clearance between the coating head 18 and the substrate 12 or the heat insulation layer 13, the supply speed of the raw material mixture, the movement speed of the substrate 12, and the like.

The coat 19 of the raw material mixture formed on the substrate 12 or the heat insulation layer 13 can be formed into the elastic layer 14 by heating the coat 19 for a predetermined period of time with heating device such as an electric furnace so as to allow a crosslinking reaction to proceed.

(2-3) Releasing Layer

Any one of fluorine resins such as the following exemplified resins is mainly used as a heat-resistant high molecular compound for the releasing layer 15:

a tetrafluoroethylene-perfluoro(alkyl vinyl ether) copolymer (PFA), polytetrafluoroethylene (PTFE), a tetrafluoroethylene-hexafluoropropylene copolymer (FEP), and the like.

Of those exemplified materials, PFA is preferred from the viewpoints of forming property and toner releasing property.

Formation method is not particularly limited, and a method involving covering an elastic layer with a tube-shaped molding, a method involving applying fine particles of a fluorine resin directly to the surface of an elastic layer or applying fine particles of a fluorine resin dispersed in a solvent to form a paint to the surface of an elastic layer, and thereafter stoving the applied fine particles onto the surface through drying and melting.

The thickness of the fluorine resin releasing layer is preferably 10 μm or more and 50 μm or less, more preferably 30 μm or less, and is preferably designed to a thickness of 10% or less of the elastic layer. This is because the flexibility of the elastic layer when the releasing layer is laminated thereon is kept, and the surface hardness as a heating member can be prevented from becoming too high.

The heat generation effect of a microwave similar to that of the elastic layer can also be obtained by allowing a resin material to contain the carbon fiber described above during forming of the releasing layer.

(2-4)

As a fixing member according to another embodiment of the present invention, a configuration in which a substrate, an elastic layer, and a releasing layer are provided in the stated order, and the releasing layer is a heat generating layer according to the present invention is described.

In this embodiment, the description of the section (2-1) is Cited for Regarding the Substrate.

Further, in this embodiment, the elastic layer may be used as a heat generating layer together with the releasing layer, and the configuration, material, and production method of the elastic layer serving as a heat generating layer are as described in the sections (2-2-1) to (2-2-4).

On the other hand, as a specific example of the elastic layer not serving as a heat generating layer, there is given a layer containing a cured product of the addition-curing type silicone rubber described in the section (2-2-1) and not containing the carbon fiber described in the section (2-2-2).

The inorganic filler described in the section (2-2-3) can be incorporated into such elastic layer. In addition, when such elastic layer is formed by blending hollow microballoons formed of glass or a resin, as a filler, in the base material such as the silicon rubber described above for the purpose of reducing heat conductivity, an elastic layer having lower heat conductivity can be formed as compared to the case where only the base material is used. Further, a similar effect can also be expected by using a silicone rubber layer containing a water-absorbing polymer or a sponge rubber layer obtained by subjecting a silicone rubber to hydrogen blowing. In addition, a solid rubber layer may be used as long as its heat conductivity is low.

Such elastic layer can be produced by the method described in the section (2-2-4).

(2-4-1)

Figure 5:
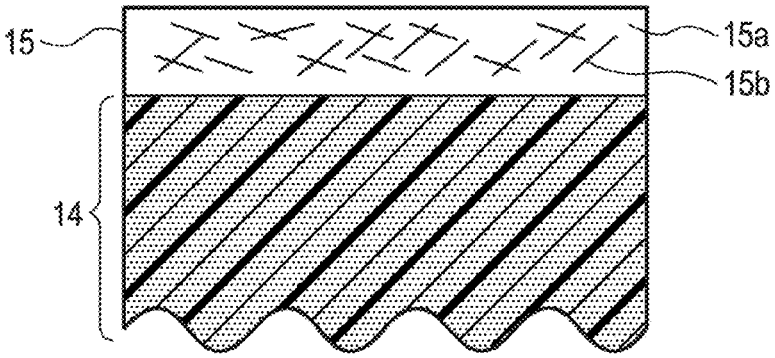
FIG. 5 is a schematic sectional view of a vicinity of a surface of a hating member including a releasing layer as a heat generating layer according to the present invention.

In FIG. 5, the elastic layer 14, and the releasing layer 15 serving as a heat generating layer are illustrated. In FIG. 5, a heat-resistant high molecular compound 15*a* such as a fluorine resin, and a carbon fiber 15*b* are illustrated.

Specific examples of the fluorine resin include a tetrafluoroethylene-perfluoro(alkyl vinyl ether) copolymer (PFA), polytetrafluoroethylene (PTFE), and a tetrafluoroethylene-hexafluoropropylene copolymer (FEP).

Regarding the carbon fiber 15*b*, the description in the section (2-2-2) is cited.

The content of the carbon fiber contained in the releasing layer is preferably 0.5% by volume or more, more preferably 1.0% by volume or more with respect the releasing layer from the viewpoint of heat generation property. On the other hand, when the carbon fiber is contained in a large amount in the releasing layer, although heat generation performance is enhanced, the ratio of the fluorine resin is reduced to degrade toner releasing property. Therefore, the content of the carbon fiber is preferably 30% by volume or less, more preferably 20% by volume or less with respect to the releasing layer. A sufficient heat generation amount can be obtained while the toner releasing property is maintained by setting the content of the carbon fiber within such range.

(2-4-2) Production Method for Releasing Layer Serving as Heat Generating Layer

As a production method for the releasing layer serving as a heat generating layer, the following methods i) to iii) are given: i) a method involving covering an elastic layer with a tube-shaped molding of a fluorine resin containing carbon fiber; (ii) a method involving causing fine particles of a fluorine resin containing carbon fiber to adhere directly to the surface an elastic layer and then melting the fine particles to form a thin film; and iii) a method involving forming a coat of a paint in which a fluorine resin containing a carbon fiber is dispersed and/or dissolved and the carbon fiber is dispersed on the surface of an elastic layer, drying the coat, and melting the fluorine resin.

The thickness of the fluorine resin releasing layer is preferably 10 μm or more and 100 μm or less, more preferably 70 μm or less. When the thickness of the fluorine resin releasing layer falls within the above-mentioned range, the surface hardness as a heating member can be prevented from becoming too high.

(2-5)

As a fixing member according to still another embodiment of the present invention, a configuration in which a substrate, an elastic layer, an intermediate layer, and a releasing layer are provided in the stated order, and the intermediate layer is a heat generating layer according to the present invention is described.

Figure 7:
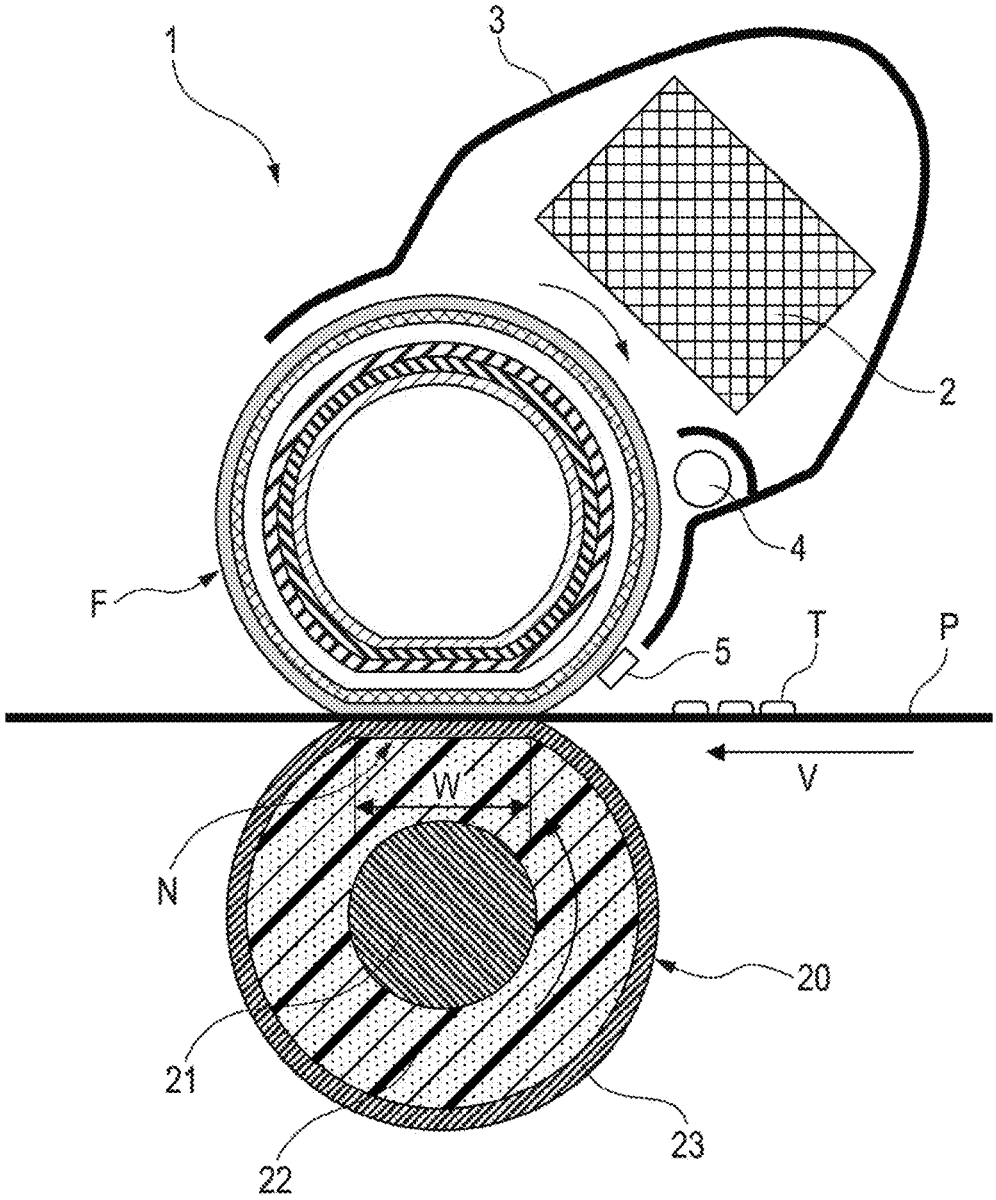
FIG. 7 is an explanatory diagram of a fixing device according to another embodiment of the present invention.

FIG. 7 is a schematic sectional view of the fixing device according to this embodiment. Members like those of FIG. 1 are denoted by like reference symbols.

In FIG. 7, a fixing device 1 includes a fixing belt F serving as a rotatable heating member for heating an image on a recording material in a fixing nip portion N and a rotatable pressurizing roller 20 serving as a pressurizing member.

The fixing belt F and the pressurizing roller 20 are arranged substantially in parallel to each other vertically and brought into pressure contact with each other with a pressure spring (not shown) at an end portion. Thus, the fixing nip portion (pressure-contact nip portion) N with a predetermined width is formed in a recording material conveyance direction between the fixing belt F and the pressurizing roller 20.

The fixing belt F is rotated by drive device (not shown) at a predetermined circumferential speed in a clockwise direction indicated by an arrow. The fixing belt F is driven to rotate by the rotation of the pressurizing roller 20. Note that the fixing belt F and the pressurizing roller 20 may be rotated separately.

A microwave generating unit 2 (configuration corresponding to the "microwave generating unit" of claim 1) generates a microwave to the fixing belt F and heats the fixing belt F from outside. The microwave generating unit generates a microwave of 300 to 1,500 W having a frequency of 300 MHz to 30 GHz from a microwave generating source such as a magnetron provided in the microwave generating unit 2. Note that a usable frequency range of a microwave to be output is not limited, but a frequency of 2,450 MHz is widely used in a microwave heating device because a practical range is defined as an industrial, scientific and medical band (so-called ISM band) by the International Telecommunication Union.

The microwave generating unit 2 and the fixing belt F are arranged at a distance of 1 mm or more in a non-contact state so as to prevent the foreign matters and toner adhering onto the fixing belt from being transferred.

A microwave reflecting member 3 made of a metal such as aluminum is provided on the periphery of the microwave generating unit 2 and the fixing belt F forming the fixing device 1. This configuration can prevent a microwave generated by the microwave generating unit 2 from leaking to outside of the fixing device, and can reflect and transmit the microwave to the surface of the fixing belt F. The microwave reflecting member 3 may have a mesh structure as long as it can reflect a microwave.

A reflecting member for diffusing a microwave (not shown) is provided in the microwave generating unit 2 so that the entire region of the fixing belt F in a length direction (direction perpendicular to the drawing surface) can be irradiated with a microwave uniformly.

The length dimension (direction perpendicular to the drawing surface) of each of the fixing belt F and the pressurizing roller 20 is larger than the maximum paper passage width of the fixing device.

The fixing belt F which is rotating is heated from outside by the microwave generating unit 2 and is supplied with a heat quantity necessary and sufficient for fixing an unfixed toner image T on a recording material P in the fixing nip portion N.

After the unfixed toner image T is formed on the recording material P in an image forming section (not shown), the recording material P is sent to the fixing device 1, and introduced into the fixing nip portion N formed by the fixing belt F and the pressurizing roller 20 to be held and conveyed. While the recording material P is being held and conveyed in the fixing nip portion N, the recording material P is heated by the fixing belt F for a time "t" per rotation of the belt, and is supplied with a pressure of the nip portion, with the result that the unfixed toner image T is fixed under thermal pressure on the recording material P as a permanent fixed image.

(2-5-1) Outline of Configuration of Heating Member

Figure 10A:
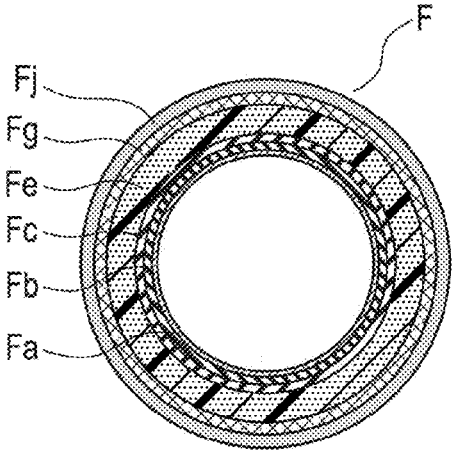
FIG. 10A is a schematic sectional view of a heating member including an intermediate layer as a heat generating layer according to the present invention.
Figure 10B:
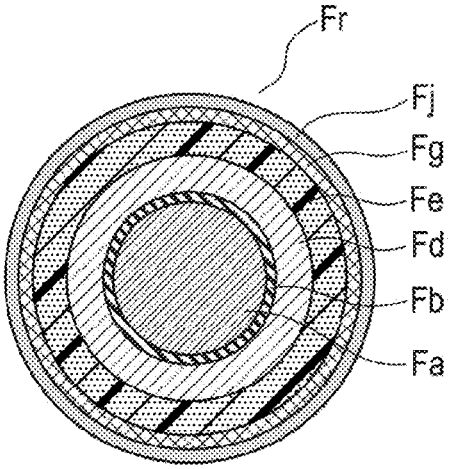
FIG. 10B is a schematic sectional view of a heating member including an intermediate layer as a heat generating layer according to the present invention.

FIGS. 10A and 10B are schematic sectional views illustrating one embodiment of an electrophotographic heating member to be used in the fixing device according to this embodiment. In FIG. 10A, a belt-shaped heating member (fixing belt) F is illustrated. Further, in FIG. 10B, a fixing roller Fr is illustrated.

In FIGS. 10A and 10B, a substrate Fb, a primer layer Fc, a heat insulation layer Fd, an elastic layer Fe, an adhesive layer Fg (configuration corresponding to an "intermediate layer" of claim 6), and a releasing layer Fj are illustrated. Herein, in this example, an intermediate layer for generating heat by microwave irradiation serves as an adhesive layer for causing the elastic layer and the releasing layer to adhere to each other. However, the scope of the present invention is not limited to this configuration. Even when the intermediate layer does not have a function as the adhesive layer, the intermediate layer is included in the present invention as long as the intermediate layer has a function as a heat generating layer for generating heat by microwave irradiation.

Figure 11:
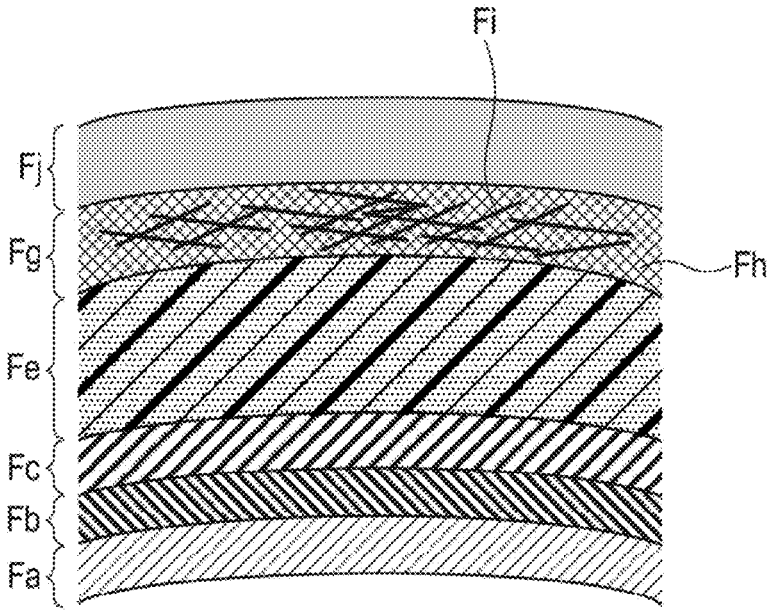
FIG. 11 is an enlarged sectional view of a vicinity of the intermediate layer of the heating member according to the present invention.

FIG. 11 is a view schematically illustrating a cross-section of an enlarged layer configuration in the vicinity of a surface of the heating member in which the intermediate layer serving as an adhesive layer is formed as a heat generating layer by being provided with a microwave absorbing material (configuration corresponding to the "carbon fiber" of claim 1). In FIG. 11, the adhesive layer Fg serving as a heat generating layer, an addition-curing type silicone rubber adhesive Fh serving as a base material, and carbon fiber Fi serving as a microwave absorbing material are illustrated. The heat insulation layer Fd is an optional layer which may be provided between the substrate Fb and the elastic layer Fe so that heat generated in the intermediate layer (adhesive layer) Fg serving as a heat generating layer may be prevented from being transmitted to the substrate Fb and the heat may be transmitted efficiently to the recording material and the unfixed toner.

(2-5-2) Substrate

When the fixing member has a belt shape as in the fixing belt F according to this embodiment, examples of the substrate Fb include: a metal or an alloy such as an electroformed nickel sleeve or a stainless steel sleeve; and a heat-resistant resin belt formed of a high molecular compound such as polyimide or polyamide imide. When the high molecular compound is used, forming through dispersion of the carbon fiber allows the substrate itself to generate heat with a microwave.

In addition, an inner-surface coat layer Fa may further be provided on the inner surface of the fixing belt in order to impart a function such as wear resistance or heat insulation property.

(2-5-3) Elastic Layer and Production Method Therefor

The elastic layer Fe is expected to serve as a layer for imparting elasticity to the heating member, the elasticity allowing the heating member to follow unevenness of paper fibers without squashing a toner during fixing. Further, in the case of the configuration of the roller-shaped heating member, the heat insulation layer Fd may be provided so as to prevent heat generated in the elastic layer Fe from permeating the substrate Fb.

In order to express such function, a heat-resistant high molecular compound is used for each of the elastic layer Fe and the heat insulation layer Fd. In particular, a heat-resistant rubber such as a silicone rubber or a fluorine rubber is preferably used as a base material for the elastic layer Fe. Of those, an addition-curing type silicone rubber is preferably cured to form the elastic layer Fe. The description of the section (2-2-1) is cited for the addition-curing type silicone rubber. In addition, the description of the section (2-2-4) is cited for a method of forming such elastic layer on the circumferential surface of the substrate Fb or the heat insulation layer Fd formed on the substrate Fb.

(2-5-4) Intermediate Layer (Adhesive Layer)

The adhesive layer (intermediate layer) Fg for fixing a fluorine resin tube on the cured-silicone-rubber elastic layer as the elastic layer Fe is formed of a cured product of an addition-curing type silicone rubber adhesive uniformly applied onto the surface of the elastic layer Fe at a thickness of preferably 15 μm or less. In addition, the addition-curing type silicone rubber adhesive includes an addition-curing type silicone rubber blended with a self-adhesive component.

Specifically, the addition-curing type silicone rubber adhesive contains an organopolysiloxane having an unsaturated hydrocarbon group typified by a vinyl group, an hydrogenorganopolysiloxane, and a platinum compound as a crosslinking catalyst, and is cured by an addition reaction. A known adhesive can be used as such adhesive. For example, an addition-curing type silicone rubber adhesive (trade name: DOW CORNING™ SE 1819 CV A/B, manufactured by Dow Corning Toray Co., Ltd.) can be used.

In addition, the adhesive layer Fg contains a carbon fiber in order to express a function as a heat generating layer.

In FIG. 11, the carbon fiber Fi is the carbon fiber described in this context. The description of the section (2-2-2) is cited for the carbon fiber.

From the viewpoint of heat generation property, the content of the carbon fiber to be contained in the adhesive layer is preferably 1.0% by volume or more, more preferably 5.0% by volume or more with respect to the adhesive layer. A uniform and sufficient heat generation amount can be obtained by setting the content of the carbon fiber within the above-mentioned range.

(2-5-5) Releasing Layer and Production Method Therefor

A fluorine resin tube formed by extrusion molding is used as the releasing layer Fj from the viewpoints of forming property and toner releasing property. For example, any one of the following exemplified resins is used as a fluorine resin as a raw material for the fluorine resin tube: a tetrafluoroethylene-perfluoro(alkyl vinyl ether) copolymer (PFA), polytetrafluoroethylene (PTFE), a tetrafluoroethylene-hexafluoropropylene copolymer (FEP), and the like. Of those resins, PFA is suitably used from the viewpoints of forming property and toner releasing property.

The thickness of the fluorine resin tube is preferably 50 μm or less. When the thickness of the fluorine resin tube falls within such range, the elasticity of a lower layer, i.e., the silicon rubber elastic layer is kept when the fluorine resin tube is laminated thereon, and the surface hardness as a fixing member can be prevented from becoming too high. The adhesiveness of the inner surface of the fluorine resin tube can be improved by performing, for example, sodium treatment, excimer laser treatment, or ammonia treatment in advance.

As a method of fixing the fluorine resin tube onto the elastic layer, there is given a method involving expanding the fluorine resin tube from outside and then covering the elastic layer with the fluorine resin tube (expansion covering method).

Figure 12:
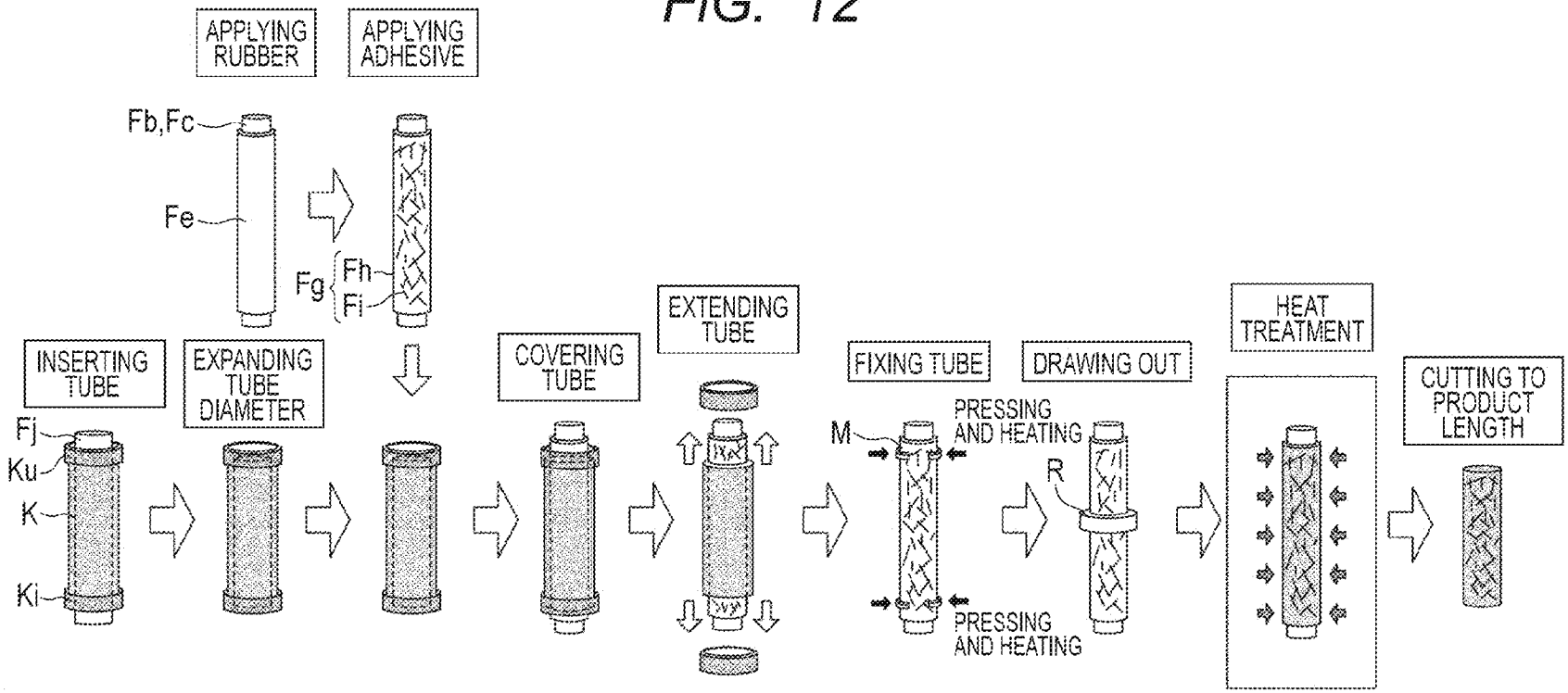
FIG. 12 is an explanatory diagram of a process of forming a releasing layer of a fixing belt according to the present invention.

FIG. 12 is a schematic diagram illustrating a process of covering a cylindrical substrate having a silicone rubber elastic layer laminated thereon with a fluorine resin tube by the expansion covering method. A cylindrical substrate having a silicone rubber elastic layer laminated thereon is set on a core cylinder (not shown) and is covered with a fluorine resin tube disposed on an inner surface of a tube expanded mold K.

A flow of the expansion covering method is described with reference to FIG. 12. A fluorine resin tube Fj is disposed on the metallic tube expanded mold K having an inner diameter larger than an outer diameter of a cylindrical substrate Fb having a silicone rubber elastic layer laminated thereon as an elastic layer Fe, and both ends of the fluorine resin tube Fj are held through use of a holding member Ku and a holding member Ki. Then, a gap between the outer surface of the fluorine resin tube Fj and the inner surface of the expanded mold K is put into a vacuum state (negative pressure with respect to atmospheric pressure). The fluorine resin tube Fj is expanded owing to the vacuum state (5 kPa), and the outer surface of the fluorine resin tube Fj and the inner surface of the expanded mold K are caused to adhere to each other. The cylindrical substrate Fb having the silicone rubber elastic layer laminated thereon is inserted into the resultant. An addition-curing type silicone rubber adhesive Fg is uniformly applied to the surface of the silicone rubber elastic layer in advance.

In this case, a ring coating method (not shown) or the like can be used for applying the adhesive. The inner diameter of the metallic tube expanded mold K is not particularly limited as long as the cylindrical substrate Fb can be inserted smoothly into the metallic tube expanded mold K. After the cylindrical substrate Fb having the silicone rubber elastic layer laminated thereon is disposed in the expanded fluorine resin tube Fj, the vacuum state (negative pressure with respect to atmospheric pressure) in the gap between the outer surface of the fluorine resin tube Fj and the inner surface of the expanded mold K is broken (negative pressure is cancelled with respect to atmospheric pressure). As a result of the breakage of the vacuum state, the fluorine resin tube Fj is reduced in the expanded diameter to the same size as the outer diameter of the cylindrical substrate Fb having the silicone rubber elastic layer laminated thereon, with the result that the fluorine resin tube Fj and the surface of the silicone rubber elastic layer are kept in close contact with each other. Next, the fluorine resin tube Fj is extended to a predetermined extension ratio. When the fluorine resin tube Fj is extended, the addition-curing type silicone rubber adhesive Fg present between the fluorine resin tube Fj and the silicone rubber elastic layer Fe serves as a lubricant, which can extend the fluorine resin tube Fj smoothly.

The fluorine resin tube Fj covers the cylindrical substrate Fb having the silicone rubber elastic layer laminated thereon, while being extended, for example, by about 8% in a longitudinal direction. Therefore, a force of returning to the original length is applied to the fluorine resin tube Fj. Then, in order to keep the extension of the fluorine rein tube Fj, the elastic layer Fe and the fluorine resin tube Fj are pressed and heated with, for example, a solid metal blank M containing a heater from outside of the fluorine resin tube so as to cause the elastic layer Fe and both ends of the fluorine resin tube Fj to adhere to each other. The temperature of the solid metal blank M during pressing and heating was set to 200° C., and the pressing and heating time was set to 20 seconds. Both ends caused to adhere to the elastic layer Fe are portions which are positioned within about 50 mm from both sides on which the fluorine resin tube Fj covers the elastic layer Fe to the center portion and which are cut in a later step.

The excess addition-curing type silicone rubber adhesive Fg not contributing to the adhesion and air which has been involved in an inner surface side of the fluorine resin tube Fj during covering are present between the elastic layer Fe and the fluorine resin tube Fj. Therefore, a draw-out step of drawing out the excess adhesive and air is required. An air ejection ring R having an inner diameter slightly larger than the outer diameter of the cylindrical substrate Fb covered with the fluorine resin tube Fj is moved in a longitudinal direction of the fluorine resin tube Fj while ejecting air (air pressure: 0.5 MPa) to the surface of the fluorine resin tube Fj in a direction perpendicular to the circumferential direction of the fluorine resin tube Fj from an upper end portion of the cylindrical substrate Fb covered with the fluorine resin tube Fj. Thus, the excess addition-curing type silicone rubber adhesive Fg not contributing to the adhesion and the air involved during covering present between the elastic layer Fe and the fluorine resin tube Fj are drawn out.

As a draw-out method, a method involving ejecting a liquid or a semi-solid may be used besides a method using an air pressure. Further, the excess addition-curing type silicone rubber adhesive Fg and the air may be drawn out through use of an extendable ring having a diameter smaller than the outer diameter of the cylindrical substrate Fb covered with the fluorine resin tube Fj.

After the draw-out step, the addition-curing type silicone rubber adhesive Fg is cured by heat treatment (heating at 200° C. for 30 minutes in an electric furnace), whereby the fluorine resin tube Fj and the elastic layer Fe are fixed over an entire region. After the heat treatment and then natural cooling, both sides are cut by a predetermined length and the resultant is polished. Thus, the fixing belt F is completed.

(3) Pressurizing Roller

As illustrated in FIG. 1, the pressurizing roller 20 has a configuration in which an elastic layer 22 is formed on an outer side of a cored bar 21 made of, for example, aluminum, iron, or an SUM material and a releasing layer 23 is formed as an outermost layer.

The pressurizing roller 20 forms the fixing nip portion N by the pressure of contact with the fixing roller 10.

As the elastic layer 22, a balloon rubber layer in which, for example, a hollow filler such as a microballoon is blended with a silicone rubber or the like is desired in the same way as in the elastic layer 14 and the heat insulation layer 13 of the fixing roller 10. Alternatively, a silicone rubber layer containing a water-absorbing polymer or a sponge rubber layer obtained by subjecting a silicone rubber to hydrogen blowing is desired. A solid rubber layer may also be used as long as the heat conductivity is low.

The pressurizing roller 20 may be a rigid cylindrical member in which the releasing layer 23 is directly formed on an outer side of the hollow cored bar 21 as long as the cored bar 21 has low heat capacity. The fixing roller 10 has the elastic layer 14, and hence the pressurizing roller 20 can form the fixing nip portion N even when the pressurizing roller 20 is not made of an elastic body.

(4) Description of Drive

In the foregoing configuration, the fixing roller 10 is rotated, and the pressurizing roller 20 is driven to rotate, and under this condition, the electric conduction to the microwave generating unit 2 is started.

Figure 6:
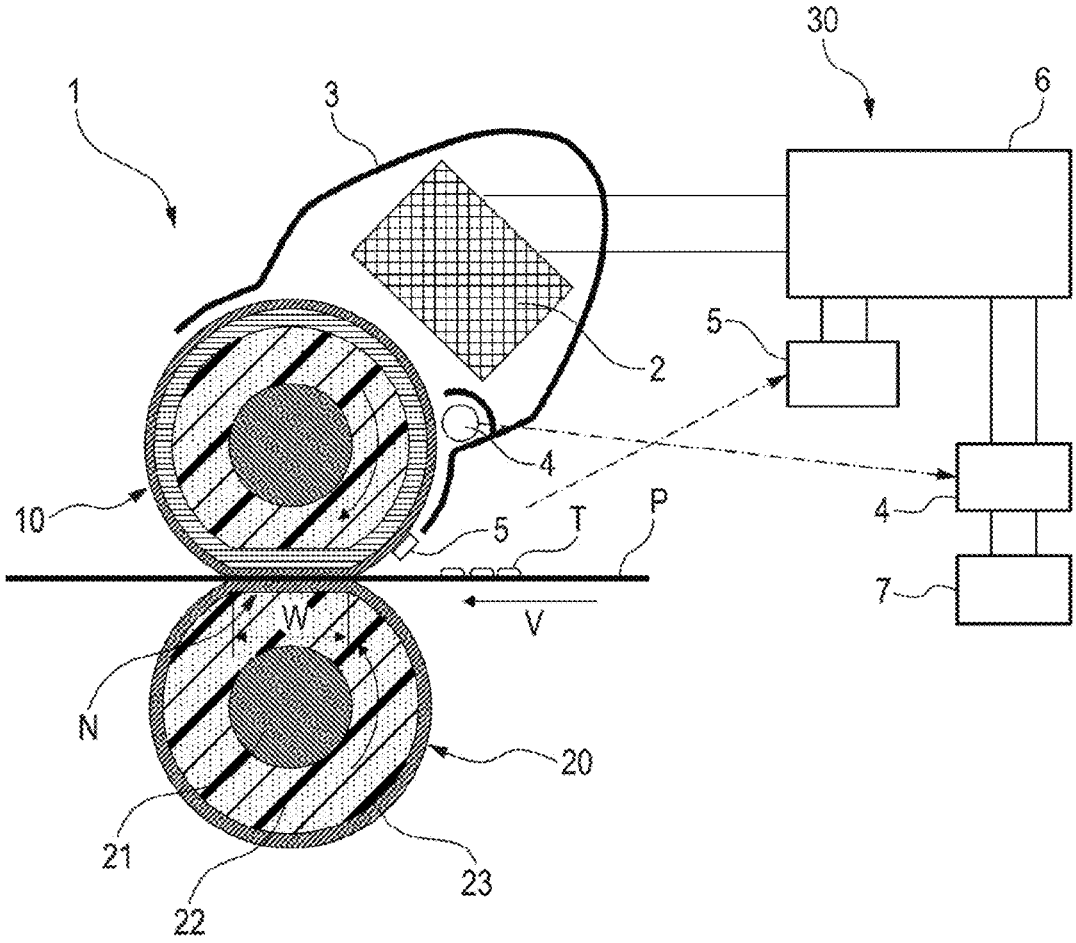
FIG. 6 is a schematic view illustrating a drive control form of the fixing device according to the present invention.

FIG. 6 illustrates the microwave generating unit 2 and communication control device 30.

A microwave output from the microwave generating unit 2 is applied to the surface of the fixing roller 10 directly or after being reflected from the microwave reflecting member 3. Then, the microwave is absorbed by the elastic layer 14 and/or the releasing layer 15 serving as a microwave absorbing layer to be changed to heat, and thus the heat is generated. The microwave which has not been absorbed passes through the elastic layer 14 and the releasing layer 15 toward the inside and is reflected by the substrate 12 of the fixing roller. Then, the microwave is applied to the elastic layer 14 and/or the releasing layer 15 serving as a microwave absorbing layer again and is absorbed by the elastic layer 14 and/or the releasing layer 15 to generate heat. By allowing the elastic layer 14 and/or the releasing layer 15 serving as a microwave absorbing layer provided only in the vicinity of the surface of the fixing roller 10 to absorb energy of a microwave to generate heat, excess energy is not required to be used for raising the temperature of the inside, and the surface temperature of the fixing roller 10 can be raised rapidly.

A microwave is generated by a magnetron (not shown) in the microwave generating unit 2 and is applied uniformly in the longitudinal direction of the fixing roller 10 directly or after being reflected by a microwave reflector (not shown) provided in the microwave generating unit 2.

The surface temperature of the fixing roller 10 is raised to temperature required for heating and fixing the unfixed toner image T on the recording material P. The temperature required for heating and fixing is appropriately set depending on the material and placement amount of the unfixed toner image T, the material and thickness of the recording material P, the drive speed and pressure force of the heating member, a fixing nip width W, and the like. The temperature required for heating and fixing is set to generally 100° C. to 250° C., preferably about 150° C. to 200° C. Time taken for the surface of the heating member to reach the setting temperature from the turn-on of electric power, that is, the time taken for achieving a fixable state is referred to as warm-up time, and the warm-up time can be shortened by adopting the configuration of the present invention.

The microwave generating unit 2 is supplied with electric power via a control device (control circuit) 6 from a power source 7 through a safety element 4 such as a thermoswitch disposed in the vicinity of the fixing roller. The output of the microwave generating unit 2 is controlled for ON/OFF and electric power amount by the control circuit 6.

The safety element 4 is shielded from a microwave by a protective tube or the like for blocking a microwave, and disposed in the vicinity of the surface of the fixing roller in a non-contact state. Then, when the temperature of the surface of the fixing roller increases abnormally, the safety element 4 is operated so as to block electric power to the control circuit 6 and the microwave generating unit 2.

The temperature of the surface of the fixing roller is detected by a temperature detecting element 5. The temperature detecting element feeds back the temperature of the surface to the control circuit 6 by a contact or non-contact method.

The control circuit 6 controls a microwave output in response to the temperature detected by the temperature detecting element 5. When the temperature of the fixing roller 10 reaches target temperature, the control device 6 suppresses an output of a microwave. When the temperature of the fixing roller 10 becomes lower by predetermined temperature than target temperature, the control device 6 increases an output of a microwave again so as to set the surface of the fixing roller 10 to be predetermined temperature.

By allowing the recording material P with the unfixed toner image T formed thereon to pass through the fixing nip portion N while the surface of the fixing roller 10 is kept at predetermined temperature, the unfixed toner image T on the recording material P is heated and fixed to obtain a fixed image.

(5) Electrophotographic Image Forming Apparatus

Figure 8:
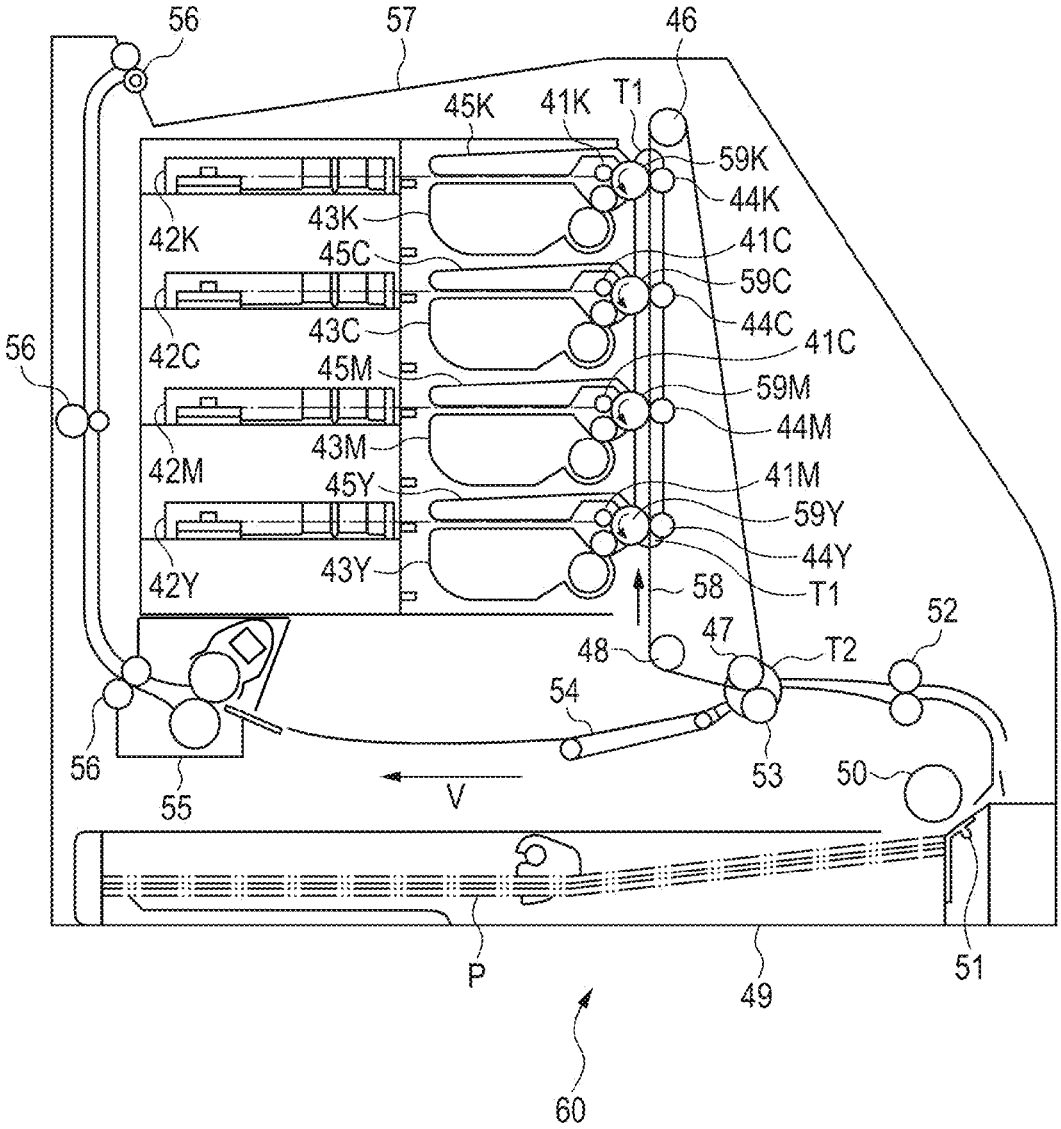
FIG. 8 is a schematic sectional view illustrating an example of an electrophotographic image forming apparatus according to the present invention.

The entire configuration of an electrophotographic image forming apparatus is described briefly. FIG. 8 is a schematic sectional view of a color laser printer according to this embodiment.

A color laser printer (hereinafter referred to as "printer") 60 illustrated in FIG. 8 includes an image forming section having an electrophotographic photosensitive drum (hereinafter referred to as "photosensitive drum") which rotates at a predetermined speed, provided for each color: yellow (Y), magenta (M), cyan (C), and black (K). Further, the color laser printer 60 includes an intermediate transfer member 58 for holding a color image subjected to development and multiple transfer in the image forming section and further transferring the color image onto the recording material P fed from a feeding section.

The photosensitive drum 59 (59Y, 59M, 59C, 59K) is rotated counterclockwise as illustrated in FIG. 8 by the drive device (not shown).

On the periphery of the photosensitive drum 59, a charging device 41 (41Y, 41M, 41C, 41K) for uniformly charging the surface of the photosensitive drum 59, a scanner unit 42 (42Y, 42M, 42C, 42K) for emitting a laser beam based on image information to form an electrostatic latent image on the photosensitive drum 59, a development unit 43 (43Y, 43M, 43C, 43K) for causing a toner to adhere to the electrostatic latent image and developing the toner as a toner image, a primary transfer roller 44 (44Y, 44M, 44C, 44K) for transferring the toner image on the photosensitive drum 59 onto the intermediate transfer member 58 in a primary transfer section T1, and a cleaning unit 45 (45Y, 45M, 45C, 45K) including a cleaning blade for removing a transfer residual toner remaining on the surface of the photosensitive drum 59 after transfer are arranged along the rotation direction of the photosensitive drum 59.

At a time of image formation, the belt-shaped intermediate transfer member 58 looped around intermediate transfer member tension rollers 46, 47, and 48 is rotated, and respective color toner images formed on the respective photosensitive drums are superimposed and primarily transferred to the intermediate transfer member 58 to form a color image.

The recording material P is conveyed to a secondary transfer section by the conveyance device in synchronization with the primary transfer to the intermediate transfer member 58. The conveyance device includes: a feed cassette 49 containing multiple recording media P; a feed roller 50; a separation pad 51; and a registration roller pair 52. At a time of image formation, the feed roller 50 is rotated according to an image formation operation and separates the recording media P in the feed cassette 49 one by one, and the registration roller pair 52 conveys the recording material P to the secondary transfer section in synchronization with the image formation operation.

In a secondary transfer section T2, a movable secondary transfer roller 53 is disposed. The secondary transfer roller 53 is capable of moving substantially vertically. Then, the secondary transfer roller 53 is pressed against the intermediate transfer member 58 at a predetermined pressure through the intermediation of the recording material P at a time of image transfer. At this time, the secondary transfer roller 53 is concurrently supplied with a bias, and the toner image on the intermediate transfer member 58 is transferred to the recording material P.

The intermediate transfer member 58 and the secondary transfer roller 53 are driven respectively. Therefore, the recording material P interposed therebetween is conveyed in a direction indicated by a left arrow in FIG. 8 at a predetermined conveyance speed V, and further conveyed to a fixing section 55 which corresponds to the subsequent step by a conveyance belt 54. In the fixing section 55, as described above, the transferred toner image is supplied with heat and pressure to be fixed onto the recording material P. The recording material P is delivered onto a delivery tray 57 on an upper surface of the apparatus by a delivery roller pair 56.

Then, an electrophotographic image forming apparatus can be obtained, which is capable of providing high-quality electrophotographic images while shortening warm-up time, by applying the fixing device according to the present invention illustrated in FIG. 1 to the fixing section 55 of the electrophotographic image forming apparatus illustrated in FIG. 8.

EXAMPLES

The present invention is described hereinafter more specifically by way of Examples.

Example A-1

A cored bar made of iron having a diameter of 22.8 mm and a length of 340 mm (not including drive/bearing portions) was prepared as a substrate, and a roller with heat insulation rubber layer provided with a heat insulation layer made of a sponge-like silicone rubber having a thickness of 3.3 mm and a heat conductivity of 0.15 W/(m·K) was provided on the cored bar.

Separately, vapor grown carbon fiber (trade name: Carbon nanofiber (VGCF); manufactured by Showa Denko K.K., average fiber diameter: 150 nm, average fiber length: 8 μm) were added as carbon fiber to a commercially available undiluted addition-curing type silicone rubber solution (trade name: SE1886; manufactured by Dow Corning Toray Co., Ltd.; "A liquid" and "B liquid" are mixed in any ratio) so that a volume filling ratio of the carbon fiber became 2%, and the resultant was kneaded to obtain a silicone rubber mixture.

The silicone rubber mixture was applied by a ring coating method to the outer circumferential surface of the heat insulation layer of the roller with heat insulation rubber layer prepared previously to a thickness of 300 μm. The obtained roller was heated in an electric furnace set to 200° C. for 4 hours to cure the silicone rubber, with the result that an elastic layer with heat generation property was formed.

An addition-curing type silicone rubber adhesive (trade name: SE1819CV; manufactured by Dow Corning Toray Co., Ltd.; "A liquid" and "B liquid" are mixed in equivalent amounts) was substantially uniformly applied to the surface of the elastic layer of the roller to a thickness of about 20 μm.

Then, a fluorine resin tube (trade name: KURANFLON-LT; manufactured by Kurabo Industries Ltd.) having an inner diameter of 29 mm and a thickness of 40 μm was laminated on the resultant while being expanded in diameter. Then, the roller surface was uniformly pressed from above the fluorine resin tube to draw out the excessive adhesive from between the elastic layer and the fluorine resin tube so that the adhesive became sufficiently thin.

Then, the roller was heated in an electric furnace set to 200° C. for 1 hour to cure the adhesive so that the fluorine resin tube was fixed onto the elastic layer, and thereafter shapes of ends were adjusted to obtain a fixing roller.

On the other hand, a pressurizing roller was obtained by causing a fluorine resin tube to adhere directly to a similar roller with heat insulation rubber layer without providing an elastic layer with heat generation property thereon.

Figure 9:
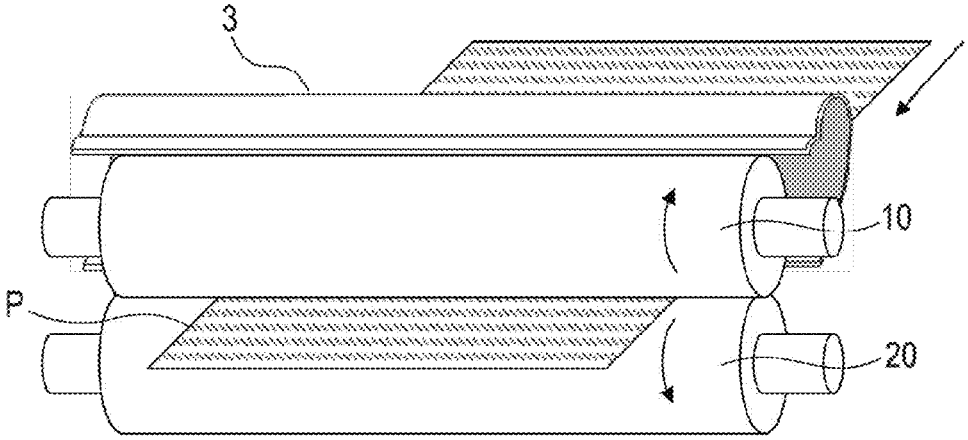
FIG. 9 is a perspective view illustrating an example of a fixing device according to the present invention.

The obtained fixing roller and pressurizing roller were arranged as illustrated in FIG. 1 or 9, and set with a total of 30 kgf of load applied to both ends of a roller shaft. While shaft portions of the fixing roller and the pressurizing roller were driven so that the surface speed became 150 mm/sec, an electric power of 700 W was supplied to the microwave generating unit. Time taken for the temperature detected by the temperature detecting element to reach 170° C. from the start of the supply of the electric power, that is, warm-up time was measured. A heating test was performed in an environment of a room temperature of 23° C. and a humidity of 50%.

Consequently, as shown in Table A-1, the worm-up time of Example A-1 was 28 seconds.

Next, the fixing device was mounted on a color laser printer (trade name: Satera LBP5910; manufactured by Canon Inc.), and an imaging timing was adjusted so that an unfixed toner image was introduced into a fixing nip portion immediately after the warm-up to form an electrophotographic image. As paper for a recording material, recycled paper of an A4 size (trade name: Recycled paper GF-R100; manufactured by Canon Inc., thickness: 92 μm, basis weight: 66 g/m$^2$, waste paper blended ratio: 70%, Beck smoothness: 23 seconds (measured by a method according to JIS P8119) was used.

Regarding the melting unevenness of the electrophotographic image thus obtained, image quality was evaluated through use of the following evaluation method.

(Evaluation Method for Melting Unevenness)

An index of followability of a heating member to paper unevenness can be obtained by observing the molten state of a toner after a toner image formed on paper is fixed.

A melting unevenness evaluation image was fixed through use of the above-mentioned color laser printer with the fixing device mounted thereon in an environment of a temperature of 10° C. and a humidity of 50% and at an input voltage of 100 V. The melting unevenness evaluation image refers to an image in which a patch image of 10 mm×10 mm formed with 100% concentration of a cyan toner and a magenta toner is disposed in the vicinity of a center portion of a paper surface.

A guideline for melting unevenness is as follows. When an image portion formed with two colors is supplied with sufficient heat and pressure, the toners are melted to form mixed color. In the case where the heat is applied to and the pressure is not applied to, in particular, a concave portion of paper unevenness, grain boundaries of the toners remain after fixing, and hence melting unevenness is caused while sufficient mixed color is not obtained. In the case where a heating member cannot sufficiently follow the unevenness, a convex portion is supplied with the pressure to form mixed color, whereas mixed color becomes insufficient in a concave portion. Therefore, the evaluation was made by observing the molten state of an image formed region.

After printing, melting unevenness was evaluated by observing an image forming section with an optical microscope. The evaluation criteria are as follows.

A: Toner grain boundaries are hardly observed even in a concave portion of paper fibers, and mixed color is obtained both in a concave portion and a convex portion.

B: Although toner grain boundaries are observed partially in a concave portion of paper fibers, mixed color is almost obtained both in a concave portion and a convex portion.

C: Mixed color is obtained only in a convex portion of paper fibers, and a great number of toner grain boundaries are observed in a concave portion.

(Example A-2) to (Example A-9) and (Comparative Example A-1) to (Comparative Example A-8)

Fixing rollers were prepared in the same way as in Example A-1 except for changing the volume filling ratios and kinds of a carbon fiber and inorganic filler in the silicone rubber mixture as described in Table A-1, and the fixing rollers were each mounted on a fixing device and an electrophotographic image forming apparatus together with the pressurizing roller produced in Example A-1. Then, warm-up time and melting unevenness were evaluated.

Note that in Examples A-1 to A-9 and Comparative Examples A-1 to A-8, the following respective carbon fibers and inorganic fillers were used.

- Examples A-1 to A-3 and A-6 to A-9: vapor grown carbon fiber (trade name: Carbon nanofiber VGCF; manufactured by Showa Denko K.K., average fiber diameter: 150 nm, average fiber length: 8 μm)
- Example A-4: vapor grown carbon fiber (trade name: Carbon nanofiber VGNF; manufactured by Showa Denko K.K., average fiber diameter: 80 nm, average fiber length: 10 μm)
- Example A-5: vapor grown carbon fiber (trade name: Carbon nanofiber VGCF-H; manufactured by Showa Denko K.K., average fiber diameter: 150 nm, average fiber length: 6 μm)
- Examples A-6 and A-7 and Comparative Example A-6: alumina (trade name: Alunabeads CB-A20S; manufactured by Showa Denko K.K., average particle diameter: 21 μm)
- Example A-8 and Comparative Example A-7: aluminum powder (trade name: high-purity spherical aluminum powder; manufactured by TOYO ALUMINIUM K.K., average particle diameter: 20 μm)
- Example A-9 and Comparative Example A-8: copper powder (trade name: Cu-HWQ; FUKUDA METAL FOIL & POWDER Co., LTD., average particle diameter: 5 μm)
- Comparative Example A-1: graphite (trade name: UF-10G; manufactured by Showa Denko K.K., average particle diameter: 5 μm)
- Comparative Examples A-2 and A-3: carbon black (trade name: DENKA BLACK; manufactured by DENKI KAGAKU KOGYO KABUSHIKI KAISHA, average primary particle diameter: 10 nm)
- Comparative Examples A-4 and A-5: silicon carbide (trade name: OY-7; manufactured by YAKUSHIMA DENKO CO., LTD., average particle diameter: 2 μm)

In the fixing roller produced in Comparative Example A-1, as a result of the measurement of warm-up time, the temperature detected by the temperature detecting element did not reach 170° C. even after the maximum 120 seconds of microwave irradiation time elapsed, and thus, the fixing device was not able to be started. Further, in the fixing roller produced in Comparative Example A-2, as a result of the measurement of warm-up time, the warm-up time was 108 seconds.

On the other hand, in the fixing roller produced in Comparative Example A-3, the warm-up time was 33 seconds. However, owing to the addition of a great amount of the filler to the elastic layer, an increase in hardness of the elastic layer was caused and the followability with respect to the unevenness of fibers of a recording material was degraded.

The evaluation results, including those of the other examples and comparative examples, are shown in Table A-1.

TABLE A-1

| | Carbon fiber | | Inorganic filler | | | Melting |
|---|---|---|---|---|---|---|
| | Kind (trade name) | Volume filling ratio (%) | Kind | Volume filling ratio (%) | Warm-up time (seconds) | unevenness evaluation rank |
| Example A-1 | "VGCF" | 2 | — | 0 | 28 | A |
| Example A-2 | "VGCF" | 3 | — | 0 | 14 | A |
| Example A-3 | "VGCF" | 4 | — | 0 | 10 | A |
| Example A-4 | "VGNF" | 2 | — | 0 | 21 | A |
| Example A-5 | "VGCF-H" | 4 | — | 0 | 18 | A |
| Comparative Example A-1 | — | 0 | Graphite | 4 | Impossible to start | — |
| Comparative Example A-2 | — | 0 | Carbon black | 4 | 108 | A |
| Comparative Example A-3 | — | 0 | Carbon black | 60 | 33 | C |
| Comparative Example A-4 | — | 0 | Silicon carbide | 4 | Impossible to start | — |
| Comparative Example A-5 | — | 0 | Silicon carbide | 60 | 38 | C |
| Example A-6 | "VGCF" | 2 | Alumina | 40 | 19 | B |
| Example A-7 | "VGCF" | 3 | Alumina | 40 | 12 | B |
| Comparative Example A-6 | — | 0 | Alumina | 40 | Impossible to start | — |
| Example A-8 | "VGCF" | 2 | Aluminum powder | 40 | 16 | B |
| Comparative Example A-7 | — | 0 | Aluminum powder | 40 | 52 | B |
| Example A-9 | "VGCF" | 2 | Copper powder | 40 | 20 | B |
| Comparative Example A-8 | — | 0 | Copper powder | 40 | 67 | B |

On the other hand, a PFA resin dispersion was sprayed onto a similar roller with elastic layer made of a sponge-like silicone rubber so as to form a releasing layer having a thickness of 30 μm, followed by drying. The resultant was heated in an electric oven at 320° C. for 15 minutes to obtain a pressurizing roller.

Example B-1

A cored bar made of iron having a diameter of 22.8 mm and a length of 340 mm (not including drive/bearing portions) was prepared as a substrate, and a roller with elastic layer made of a sponge-like silicone rubber having a thickness of 3.6 mm and a heat conductivity of 0.1 W/(m·K) was provided on the cored bar.

A paint obtained by mixing and dispersing fine particles of a fluorine resin and vapor grown carbon fibers as carbon fiber was applied to the outer circumferential surface of the elastic layer of the roller with elastic layer prepared in advance. Then, the coat was dried and melted to be stoving onto the outer circumferential surface. Specifically, vapor grown carbon fibers (trade name: Carbon nanofiber VGCF; manufactured by Showa Denko K.K., average fiber diameter: 150 nm, average fiber length: 8 μm) as carbon fiber were added to a tetrafluoroethylene/perfluoroalkyl vinyl ether copolymer (PFA) resin dispersion (AD__2CRE manufactured by Daikin Industries, Ltd.) so that a volume filling ratio of the carbon fibers became 9%. The resultant mixture was sprayed onto the outer circumferential surface of the elastic layer of the roller with elastic layer prepared in advance, followed by drying. The resultant was heated in an electric oven at 320° C. for 15 minutes to form a releasing layer. The surface of the releasing layer was polished with a polishing film (trade name: Lapika#3000; manufactured by KOVAX CORPORATION) for 30 seconds to be smoothened (surface roughness Ra: about 0.2). The thickness of the releasing layer was 40 μm. Then, the shape of each end portion was adjusted to obtain a fixing roller.

The thus obtained fixing roller and pressurizing roller were arranged as illustrated in FIG. 1 or 9, and set with a total of 30 kgf of load applied to both ends of a roller shaft. While shaft portions of the fixing roller and the pressurizing roller were driven so that the surface speed became 150 mm/sec, an electric power of 700 W was supplied to the microwave generating unit. Time taken for the temperature detected by the temperature detecting element to reach 170° C. from the start of the supply of the electric power, that is, warm-up time was measured. A heating test was performed in an environment of a room temperature of 23° C. and a humidity of 50%.

Consequently, as shown in Table B-1, the worm-up time of Example B-1 was 25 seconds.

(Evaluation Method for Releasing Property)

Next, in order to confirm releasing property, the fixing device was mounted on a color laser printer (trade name: Satera LBP5910; manufactured by Canon Inc.), and an imaging timing was adjusted so that an unfixed toner image was introduced into a fixing nip portion immediately after the warm-up to form an electrophotographic image. Regarding paper as a recording material and the unfixed toner image, recycled paper with 67 g/m$^2$ of an A4 size (manufactured by Canon Inc.) was left to stand in a high-humidity environment of 30° C./80% for 48 hours so that a moisture content of more than 9.0% was achieved, and an entire surface solid image was formed on that paper.

The evaluation of releasing property was made based on the following criteria.

Evaluation rank A: A recording material was satisfactorily separated from a fixing roller.

Evaluation rank B: Although a recording material was separated from a fixing roller, gloss unevenness caused by the unsatisfactory separation of the recording material from the fixing roller was recognized on an electrophotographic image.

Evaluation rank C: A recording material was wound around a fixing roller to cause a paper jam.

The fixing roller of this example was satisfactorily separated, and hence the releasing property thereof was evaluated as "A".

(Example B-2) to (Example B-4) and (Comparative Example B-1) to (Comparative Example B-3)

Fixing rollers were prepared in the same way as in Example B-1 except for changing the volume filling ratios and kinds of carbon fibers and inorganic filler in the releasing layer as described in Table B-1, and the fixing rollers were each mounted on a fixing device and an electrophotographic image forming apparatus together with the pressurizing roller produced in Example B-1. Then, warm-up time and releasing property were evaluated.

Note that in Examples B-1 to B-4 and Comparative Examples B-1 to B-3, the following respective carbon fibers and inorganic fillers were used.

Examples B-1 to B-4: vapor grown carbon fiber (trade name: Carbon nanofiber VGCF; manufactured by Showa Denko K.K., average fiber diameter: 150 nm, average fiber length: 8 μm)

Comparative Examples B-1 and B-2: carbon black (trade name: DENKA BLACK; manufactured by DENKI KAGAKU KOGYO KABUSHIKI KAISHA, average primary particle diameter: 10 nm)

Comparative Example B-3: silicon carbide (trade name: OY-7; manufactured by YAKUSHIMA DENKO CO., LTD., average particle diameter: 2 μm)

In the fixing roller produced in Comparative Example B-3, as a result of the measurement of warm-up time, the temperature detected by the temperature detecting element did not reach 170° C. even after the maximum 120 seconds of microwave irradiation time elapsed, and thus, the fixing device was not able to be started. Further, in the fixing roller produced in Comparative Example B-1, as a result of the measurement of warm-up time, the warm-up time was 63 seconds.

On the other hand, in the fixing roller produced in Comparative Example B-2, the warm-up time was 16 seconds. However, owing to the addition of a great amount of the filler to the releasing layer, the ratio of the fluorine resin was reduced and the releasing property was degraded. Consequently, the releasing property thereof was evaluated as "C".

The evaluation results, including those of the other examples and comparative examples, are shown in Table B-1.

TABLE B-1

| | Carbon fiber | | Inorganic filler | | | Releasing property |
|---|---|---|---|---|---|---|
| | Kind (trade name) | Volume filling ratio (%) | Kind | Volume filling ratio (%) | Warm-up time (seconds) | evaluation rank |
| Example B-1 | "VGCF" | 9 | — | 0 | 25 | A |
| Example B-2 | "VGCF" | 12 | — | 0 | 17 | A |
| Example B-3 | "VGCF" | 15 | — | 0 | 12 | A |
| Example B-4 | "VGCF" | 18 | — | 0 | 10 | B |
| Comparative Example B-1 | — | 0 | Carbon black | 9 | 63 | A |
| Comparative Example B-2 | — | 0 | Carbon black | 40 | 16 | C |
| Comparative Example B-3 | — | 0 | Silicon carbide | 15 | Impossible to start | — |

Example C-1

As a substrate, a cylindrical substrate made of a nickel-iron alloy having an inner diameter of 30 mm, a thickness of 40 μm, and a length of 343 mm was prepared, and a polyimide precursor ("U-Varnish S" manufactured by Ube Industries Ltd.) was applied to an inner surface of the substrate to a thickness of 15 μm. The resultant was baked at 200° C. for 20 minutes to imidize the polyimide precursor, whereby an inner surface sliding layer was formed. After that, a hydrosilyl-based silicone primer was applied onto the cylindrical substrate to a thickness of 5.0 μm and baked at 200° C. for 5 minutes.

A liquid addition-curing type silicone rubber mixture containing hollow microballoons was applied to the outer circumferential surface of the hydrosilyl-based silicone primer to a thickness of 300 μm and baked at 200° C. for 30 minutes. In this case, an undiluted addition-curing type silicone rubber solution was obtained by blending the following materials (a) and (b) so that the ratio (H/Vi) of the number of vinyl groups with respect to the number of Si—H groups became 0.45, and adding hollow microballoons for enhancing heat insulation property and a platinum compound serving as a catalyst.

(a) Vinylated polydimethylsiloxane having at least two vinyl groups per molecule (weight average molecular weight: 100,000 (in terms of polystyrene));

(b) Hydrogenorganopolysiloxane having at least two Si—H bonds per molecule (weight average molecular weight: 1,500 (in terms of polystyrene)).

Next, the outside of the resultant was further covered with a PFA tube having a thickness of 40 μm (manufactured by GUNZE LIMITED) as a releasing layer through intermediation of an adhesive layer having a thickness of 15 μm, and the resultant was baked at 200° C. for 2 minutes to produce a fixing belt.

The adhesive layer used in this case was obtained by adding vapor grown carbon fibers (trade name: Carbon nanofiber VGCF; manufactured by Showa Denko K.K., average fiber diameter: 150 nm, average fiber length: 8 μm) as carbon fiber to an addition-curing type silicone rubber adhesive (trade name: SE1819CV A/B, manufactured by Dow Corning Toray Co., Ltd.) so that a volume filling ratio of the carbon fibers became 2%, and followed by kneading.

Then, the silicone rubber mixture was applied by a ring coating method to the outer circumferential surface of the cylindrical substrate with rubber layer prepared in advance to cover the PFA tube through use of a vacuum expansion covering method.

The fixing belt thus obtained was mounted on a color laser printer (trade name: Satera LBP5910; manufactured by Canon Inc.), and an imaging timing was adjusted so that an unfixed toner image was introduced into a fixing nip portion immediately after the warm-up to form an electrophotographic image. As paper for a recording material, recycled paper of an A4 size (trade name: Recycled paper GF-R100; manufactured by Canon Inc., thickness: 92 μm, basis weight: 66 g/m$^2$, waste paper blended ratio: 70%, Beck smoothness: 23 seconds (measured by a method according to JIS P8119) was used.

While shaft portions of the fixing belt and the pressurizing roller were driven so that the surface speed became 150 mm/sec, an electric power of 700 W was supplied to the microwave generating unit. Time taken for the temperature detected by the temperature detecting element to reach 170° C. from the start of the supply of the electric power, that is, warm-up time was measured. A heating test was performed in an environment of a room temperature of 23° C. and a humidity of 50%. Consequently, as shown in Table C-1, the worm-up time of Example C-1 was 25 seconds.

The melting unevenness of the electrophotographic image thus obtained was evaluated through use of the method described in the section (Evaluation method for melting unevenness). Table C-1 shows the results.

(Example C-2) to (Example C-5) and (Comparative Example C-1) to (Comparative Example C-6)

Fixing belts were prepared in the same way as in Example C-1 except for changing the volume filling ratios and kinds of carbon fibers and inorganic filler in the adhesive layer or the thickness of the adhesive layer as described in Table C-1, and the fixing belts were each mounted on a fixing device and an electrophotographic image forming apparatus. Then, warm-up time and melting unevenness were evaluated.

Note that in Examples C-1 to C-5 and Comparative Examples C-1 to C-6, the following respective carbon fibers and inorganic fillers were used.

Examples C-1 to C-3 and Comparative Examples C-5 and C-6: vapor grown carbon fiber (trade name: Carbon nanofiber VGCF; manufactured by Showa Denko K.K., average fiber diameter: 150 nm, average fiber length: 8 μm)

Example C-4: vapor grown carbon fiber (trade name: Carbon nanofiber VGNF; manufactured by Showa Denko K.K., average fiber diameter: 80 nm, average fiber length: 10 μm)

Example C-5: vapor grown carbon fiber (trade name: Carbon nanofiber VGCF—H; manufactured by Showa Denko K.K., average fiber diameter: 150 nm, average fiber length: 6 μm)

Comparative Example C-1: graphite (trade name: UF-10G; manufactured by Showa Denko K.K., average particle diameter: 5 μm)

Comparative Examples C-2 and C-3: carbon black (trade name: DENKA BLACK; manufactured by DENKI KAGAKU KOGYO KABUSHIKI KAISHA, average primary particle diameter: 10 nm)

Comparative Example C-4: silicon carbide (trade name: OY-7; manufactured by YAKUSHIMA DENKO CO., LTD., average particle diameter: 2 μm)

In each of the fixing belts produced in Comparative Example C-1 and Comparative Example C-4, as a result of the measurement of warm-up time, the temperature detected by the temperature detecting element did not reach 170° C. even after the maximum 120 seconds of microwave irradiation time elapsed, and thus, the fixing device was not able to be started.

Further, in the fixing belt produced in Comparative Example C-2, as a result of the measurement of warm-up time, the warm-up time was 96 seconds.

On the other hand, in the fixing belt produced in Comparative Example C-3, the warm-up time was somewhat shortened to 61 seconds. However, owing to the addition of a great amount of the filler to the adhesive layer, an increase in hardness of the adhesive layer was caused and the followability with respect to the unevenness of fibers of a recording material was degraded. Consequently, the melting unevenness was evaluated as "C".

Further, in the fixing belts produced in Comparative Example C-5 and Comparative Example C-6, the warm-up time was satisfactory: 20 seconds (Comparative Example C-5) and 7 seconds (Comparative Example C-6). However, owing to the increase in thickness of the adhesive layer, an increase in microhardness of the fixing belt was caused and the followability with respect to the unevenness of fibers of a recording material was degraded.

The evaluation results of the respective examples and comparative examples are shown in Table C-1.

TABLE C-1

| | | Carbon fiber | | Inorganic filler | | | |
|---|---|---|---|---|---|---|---|
| | Thickness of adhesive layer (μm) | Kind (trade name) | Volume filling ratio (%) | Kind | Volume filling ratio (%) | Warm-up time (seconds) | Melting unevenness evaluation rank |
| Example C-1 | 15 | VGCF | 20 | — | 0 | 25 | A |
| Example C-2 | 15 | VGCF | 30 | — | 0 | 13 | A |
| Example C-3 | 15 | VGCF | 40 | — | 0 | 9 | A |
| Example C-4 | 15 | VGNF | 20 | — | 0 | 19 | A |
| Example C-5 | 15 | VGCF-H | 40 | — | 0 | 16 | A |
| Comparative Example C-1 | 15 | — | 0 | Graphite | 40 | Impossible to start | — |
| Comparative Example C-2 | 15 | — | 0 | Carbon black | 40 | 96 | A |
| Comparative Example C-3 | 15 | — | 0 | Carbon black | 60 | 61 | C |
| Comparative Example C-4 | 15 | — | 0 | Silicon carbide | 40 | Impossible to start | — |
| Comparative Example C-5 | 30 | VGCF | 20 | — | — | 20 | C |
| Comparative Example C-6 | 30 | VGCF | 40 | — | — | 7 | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2012-282982, filed Dec. 26, 2012, 2013-211709, filed Oct. 9, 2013, and 2013-211711, filed Oct. 9, 2013 which are hereby incorporated by reference herein in their entirety.

What is claimed is:

1. A fixing device, comprising:

a heating member;

a pressurizing member; and a microwave generating unit, the fixing device being configured to fix an unfixed toner on a recording material by passing the recording material through a nip formed by the heating member and the pressurizing member, wherein:

the heating member comprises a heat generating layer for generating heat with a microwave generated by the microwave generating unit;

the heat generating layer contains a high molecular compound and a carbon fiber; and wherein:

the carbon fiber has an average fiber diameter of 80 nm or more and 150 nm or less, has an average fiber length of 6 μm or more and 10 μm or less, and has, in a Raman spectrum, an absorption peak resulting from a graphite structure.

2. The fixing device according to claim 1, wherein the heating member comprises a substrate, an elastic layer, and a releasing layer in the stated order, and at least one of the elastic layer and the releasing layer is the heat generating layer.

3. The fixing device according to claim 2, wherein the elastic layer is the heat generating layer, and the elastic layer contains a silicone rubber and the carbon fiber, and a content of the carbon fiber is 0.1% by volume or more and 20% by volume or less with respect to the elastic layer.

4. The fixing device according to claim 2, wherein the elastic layer further contains at least one of inorganic filler selected from the group consisting of silicon carbide, silicon nitride, boron nitride, aluminum nitride, alumina, zinc oxide, magnesium oxide, silica, copper, aluminum, silver, iron, nickel, and metal silicon.

5. The fixing device according to claim 1, wherein the heating member comprises a substrate, an elastic layer, and a releasing layer in the stated order, and the releasing layer is the heat generating layer.

6. The fixing device according to claim 1, wherein the heating member comprises a substrate, an elastic layer, an intermediate layer having a thickness of 15 μm or less, and a releasing layer in the stated order, and the intermediate layer is the heat generating layer.

7. The fixing device according to claim 6, wherein the heating member is a fixing belt.

8. An electrophotographic image forming apparatus, comprising:

an electrophotographic photosensitive drum;

a charging device for charging the electrophotographic photosensitive drum; and a fixing device for heating a toner image transferred onto a recording material to fix the toner image on the recording material, wherein the fixing device comprises the fixing device according to claim 1.

* * * * *